US008098014B2

(12) United States Patent
Takatsuka et al.

(10) Patent No.: US 8,098,014 B2
(45) Date of Patent: Jan. 17, 2012

(54) MERCURY-FREE ARC TUBE FOR DISCHARGE LAMP UNIT

(75) Inventors: Hiroyuki Takatsuka, Shizuoka (JP); Masaya Shido, Shizuoka (JP)

(73) Assignee: Koito Manufacturing Co., Ltd, Tokyo (JP)

( * ) Notice: Subject to any disclaimer, the term of this patent is extended or adjusted under 35 U.S.C. 154(b) by 200 days.

(21) Appl. No.: 12/369,414

(22) Filed: Feb. 11, 2009

(65) Prior Publication Data

US 2009/0200944 A1 Aug. 13, 2009

(30) Foreign Application Priority Data

Feb. 12, 2008 (JP) ..... 2008-030735
Jan. 28, 2009 (JP) ..... 2009-017199

(51) Int. Cl.
*H01J 61/18* (2006.01)

(52) U.S. Cl. ..... 313/638; 313/570; 313/637

(58) Field of Classification Search ..... 313/623, 313/627–643, 567, 111–117, 25–27, 318.01–318.09; 439/615, 739; 445/24, 26, 29, 22
See application file for complete search history.

(56) References Cited

U.S. PATENT DOCUMENTS 7,242,144 B2 7/2007 Kato et al.
2005/0040768 A1 * 2/2005 Kato et al. ..... 313/635

FOREIGN PATENT DOCUMENTS

CN 1559078 A 12/2004
JP 2003-168391 A 6/2003

OTHER PUBLICATIONS

First Office Action issued in counterpart Chinese Application No. 200910130794.2 dated Mar. 1, 2010.

* cited by examiner

*Primary Examiner* — Nimeshkumar Patel
*Assistant Examiner* — Donald Raleigh
(74) *Attorney, Agent, or Firm* — Sughrue Mion, PLLC

(57) ABSTRACT

There is provided a mercury-free arc tube for a discharge lamp unit. The mercury-free arc tube includes a plurality of electrodes and a sealed chamber including a metal halide and a starting rare gas enclosed in the sealed chamber. A clearness index value $P^2 \cdot W/\rho$ is equal to or greater than about 800, where ρ denotes a density ($mg/cm^3$) of the enclosed metal halide, P denotes a pressure (atmospheres) of the enclosed starting rare gas, and W denotes a maximum input power (watts) input to the sealed chamber through the electrodes.

16 Claims, 18 Drawing Sheets

FIG. 3A IMMEDIATELY AFTER LAMP-ON TIMING
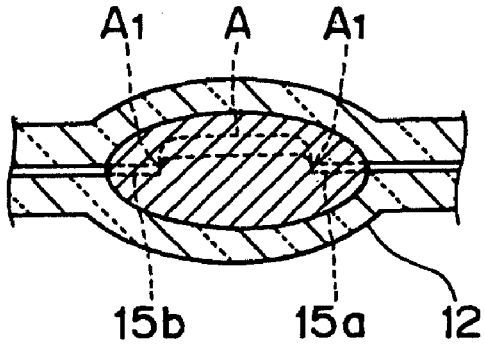
FIG. 3B AFTER FOUR SECONDS FROM LAMP-ON TIMING
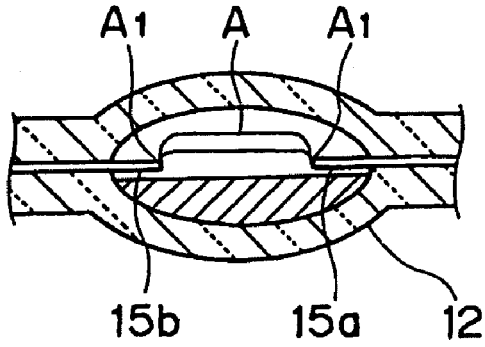
FIG. 3C AFTER TEN SECONDS FROM LAMP-ON TIMING
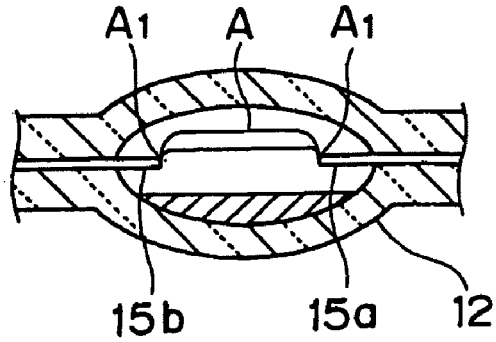

FIG. 4 (CONT.)

| SPECIFICATION/ARC TUBE (GROUP) | STAND-ARD | GROUP 1-1 | GROUP 1-2 | GROUP 1-3 | GROUP 2-1 | GROUP 2-2 | GROUP 2-3 | GROUP 2-4 |
|---|---|---|---|---|---|---|---|---|
| | | IODIDE AMOUNT | | | IODIDE AMOUNT | | | |
| | | DECREASE | DECREASE | INCREASE | DECREASE | DECREASE | INCREASE | INCREASE |
| OUTER DIAMETER (mm) OF LIGHT EMITTING TUBE | 6.10 | 6.10 | 6.10 | 6.10 | 6.10 | 6.10 | 6.10 | 6.10 |
| INNER DIAMETER (mm) OF LIGHT EMITTING TUBE | 2.50 | 2.50 | 2.50 | 2.50 | 2.50 | 2.50 | 2.50 | 2.50 |
| THICKNESS ((OUTER DIAMETER) - (INNER DIAMETER): mm) | 1.80 | 1.80 | 1.80 | 1.80 | 1.80 | 1.80 | 1.80 | 1.80 |
| INNER VOLUME (CALCULATED FROM INNER DIAMETER OF TUBE) | 22.1 | 22.1 | 22.1 | 22.1 | 22.1 | 22.1 | 22.1 | 22.1 |
| IODIDE AMOUNT (mg) | 0.30 | 0.10 | 0.20 | 0.40 | 0.10 | 0.20 | 0.40 | 0.50 |
| IODIDE DENSITY $\rho$ (mg/cm$^3$) | 13.58 | 4.53 | 9.05 | 18.11 | 4.53 | 9.05 | 18.11 | 22.64 |
| Xe ENCLOSURE PRESSURE P (atm) | 14.5 | 14.5 | 14.5 | 14.5 | 16.0 | 16.0 | 16.0 | 16.0 |
| MAXIMUM INPUT POWER W (WATT) | 70.0 | 70.0 | 70.0 | 70.0 | 70.0 | 70.0 | 70.0 | 70.0 |
| LONGITUDINAL-SECTIONAL CLEARNESS RATIO (%) AFTER FOUR SECONDS | 68% | 90% | 80% | 54% | 92% | 78% | 55% | 50% |
| LUMINOUS FLUX VALUE (lm) AFTER FOUR SECONDS | 1300 | 1100 | 1200 | 1400 | 1300 | 1400 | 1600 | 1700 |
| LUMINOUS FLUX VALUE x (%) AFTER FOUR SECONDS | 43% | 41% | 41% | 45% | 48% | 47% | 50% | 52% |
| LUMINOUS-INTENSITY-VALUE STANDARD (cd) AFTER FOUR SECONDS: ≥ 6250cd | 6700 | 6700 | 6800 | 6400 | 7100 | 7200 | 6500 | 6200 |
| LUMINOUS INTENSITY VALUE y (%) AFTER FOUR SECONDS | 53% | 59% | 56% | 49% | 63% | 58% | 48% | 45% |
| CLEARNESS PROPORTIONAL VALUE y/x (%) | 123% | 145% | 135% | 109% | 131% | 123% | 97% | 88% |
| RISE (OVERALL EVALUATION INCLUDING CLEARNESS) | O | O | O | Δ | O | O | Δ | X |
| CLEARNESS INDEX VALUE $P^2W/\rho$ | 1084 | 3251 | 1625 | 813 | 3958 | 1979 | 990 | 792 |
| LIFETIME (HOUR) | 2800 | 2000 | 2800 | 2600 | 2100 | 2600 | 2500 | 2400 |
| LIFETIME DURABILITY | O | X | O | O | Δ | O | O | Δ |
| OVERALL EVALUATION | O | X | O | Δ | Δ | O | Δ | X |

*(FIG. 4 CONTINUED)*

| SPECIFICATION/ARC TUBE (GROUP) | STAND-ARD | GROUP 3-1 | GROUP 3-2 | GROUP 3-3 | GROUP 3-4 | GROUP 3-5 |
|---|---|---|---|---|---|---|
| | | IODIDE AMOUNT | | | | |
| | | DECREASE | DECREASE | DECREASE | INCREASE | INCREASE |
| OUTER DIAMETER (mm) OF LIGHT EMITTING TUBE | 6.10 | 5.90 | 5.90 | 5.90 | 5.90 | 5.90 |
| INNER DIAMETER (mm) OF LIGHT EMITTING TUBE | 2.50 | 2.30 | 2.30 | 2.30 | 2.30 | 2.30 |
| THICKNESS ((OUTER DIAMETER) - (INNER DIAMETER): mm) | 1.80 | 1.80 | 1.80 | 1.80 | 1.80 | 1.80 |
| INNER VOLUME (CALCULATED FROM INNER DIAMETER OF TUBE) | 22.1 | 18.7 | 18.7 | 18.7 | 18.7 | 18.7 |
| IODIDE AMOUNT (mg) | 0.30 | 0.10 | 0.20 | 0.30 | 0.40 | 0.50 |
| IODIDE DENSITY $\rho$ (mg/cm$^3$) | 13.58 | 5.35 | 10.70 | 16.05 | 21.39 | 26.74 |
| Xe ENCLOSURE PRESSURE P (atm) | 14.5 | 17.5 | 17.5 | 17.5 | 17.5 | 17.5 |
| MAXIMUM INPUT POWER W (WATT) | 70.0 | 70.0 | 70.0 | 70.0 | 70.0 | 70.0 |
| LONGITUDINAL-SECTIONAL CLEARNESS RATIO (%) AFTER FOUR SECONDS | 68% | 93% | 84% | 69% | 56% | 52% |
| LUMINOUS FLUX VALUE (lm) AFTER FOUR SECONDS | 1300 | 1400 | 1500 | 1500 | 1600 | 1700 |
| LUMINOUS FLUX VALUE x (%) AFTER FOUR SECONDS | 43% | 50% | 48% | 47% | 50% | 52% |
| LUMINOUS-INTENSITY-VALUE STANDARD (cd) AFTER FOUR SECONDS: ≥ 6250cd | 6700 | 7400 | 7400 | 7000 | 6800 | 6500 |
| LUMINOUS INTENSITY VALUE y (%) AFTER FOUR SECONDS | 53% | 63% | 57% | 52% | 51% | 47% |
| CLEARNESS PROPORTIONAL VALUE y/x (%) | 123% | 127% | 118% | 112% | 102% | 91% |
| RISE (OVERALL EVALUATION INCLUDING CLEARNESS) | O | O | O | O | O | Δ |
| CLEARNESS INDEX VALUE $P^2W/\rho$ | 1084 | 4008 | 2004 | 1336 | 1002 | 802 |
| LIFETIME (HOUR) | 2800 | 2000 | 2400 | 2600 | 2500 | 2500 |
| LIFETIME DURABILITY | O | X | Δ | O | O | O |
| OVERALL EVALUATION | O | X | Δ | O | O | Δ |

FIG. 5 (CONT.)

| SPECIFICATION/ARC TUBE (GROUP) | STAND-ARD | GROUP 4-1 | GROUP 4-2 | GROUP 5-1 | GROUP 5-2 | GROUP 5-3 | GROUP 5-4 |
|---|---|---|---|---|---|---|---|
| | | INNER DIAMETER | | Xe PRESSURE | | | |
| | | DECREASE | INCREASE | DECREASE | DECREASE | INCREASE | INCREASE |
| OUTER DIAMETER (mm) OF LIGHT EMITTING TUBE | 6.10 | 5.90 | 6.30 | 6.10 | 6.10 | 6.10 | 6.10 |
| INNER DIAMETER (mm) OF LIGHT EMITTING TUBE | 2.50 | 2.30 | 2.70 | 2.50 | 2.50 | 2.50 | 2.50 |
| THICKNESS ((OUTER DIAMETER) - (INNER DIAMETER): mm) | 1.80 | 1.80 | 1.80 | 1.80 | 1.80 | 1.80 | 1.80 |
| INNER VOLUME (CALCULATED FROM INNER DIAMETER OF TUBE) | 22.1 | 18.7 | 25.8 | 22.1 | 22.1 | 22.1 | 22.1 |
| IODIDE AMOUNT (mg) | 0.30 | 0.30 | 0.30 | 0.30 | 0.30 | 0.30 | 0.30 |
| IODIDE DENSITY $\rho$ (mg/cm$^3$) | 13.58 | 16.05 | 11.64 | 13.58 | 13.58 | 13.58 | 13.58 |
| Xe ENCLOSURE PRESSURE P (atm) | 14.5 | 14.5 | 14.5 | 10.0 | 13.0 | 16.0 | 20.0 |
| MAXIMUM INPUT POWER W (WATT) | 70.0 | 70.0 | 70.0 | 70.0 | 70.0 | 70.0 | 70.0 |
| LONGITUDINAL-SECTIONAL CLEARNESS RATIO (%) AFTER FOUR SECONDS | 68% | 65% | 78% | 70% | 68% | 70% | 69% |
| LUMINOUS FLUX VALUE (lm) AFTER FOUR SECONDS | 1300 | 1500 | 1200 | 800 | 1000 | 1500 | 1900 |
| LUMINOUS FLUX VALUE x (%) AFTER FOUR SECONDS | 43% | 47% | 43% | 31% | 37% | 47% | 56% |
| LUMINOUS-INTENSITY-VALUE STANDARD (cd) AFTER FOUR SECONDS: ≥ 6250cd | 6700 | 6500 | 6600 | 4300 | 6400 | 7800 | 9700 |
| LUMINOUS INTENSITY VALUE y (%) AFTER FOUR SECONDS | 53% | 48% | 56% | 38% | 45% | 59% | 69% |
| CLEARNESS PROPORTIONAL VALUE y/x (%) | 123% | 103% | 131% | 125% | 123% | 125% | 124% |
| RISE (OVERALL EVALUATION INCLUDING CLEARNESS) | O | Δ | O | X | Δ | O | O |
| CLEARNESS INDEX VALUE $P^2W/\rho$ | 1084 | 917 | 1264 | 515 | 871 | 1319 | 2062 |
| LIFETIME (HOUR) | 2800 | 2800 | 3000 | 3500 | 3000 | 2800 | 2100 |
| LIFETIME DURABILITY | O | O | O | O | O | O | Δ |
| OVERALL EVALUATION | O | Δ | O | X | Δ | O | Δ |

*(FIG. 5 CONTINUED)*

| SPECIFICATION/ARC TUBE (GROUP) | STAND-ARD | GROUP 6-1 | GROUP 6-2 | GROUP 6-3 | GROUP 6-4 |
|---|---|---|---|---|---|
| | | POWER | | | |
| | | DECREASE | DECREASE | INCREASE | INCREASE |
| OUTER DIAMETER (mm) OF LIGHT EMITTING TUBE | 6.10 | 6.10 | 6.10 | 6.10 | 6.10 |
| INNER DIAMETER (mm) OF LIGHT EMITTING TUBE | 2.50 | 2.50 | 2.50 | 2.50 | 2.50 |
| THICKNESS ((OUTER DIAMETER) - (INNER DIAMETER): mm) | 1.80 | 1.80 | 1.80 | 1.80 | 1.80 |
| INNER VOLUME (CALCULATED FROM INNER DIAMETER OF TUBE) | 22.1 | 22.1 | 22.1 | 22.1 | 22.1 |
| IODIDE AMOUNT (mg) | 0.30 | 0.30 | 0.30 | 0.30 | 0.30 |
| IODIDE DENSITY $\rho$ (mg/cm$^3$) | 13.58 | 13.58 | 13.58 | 13.58 | 13.58 |
| Xe ENCLOSURE PRESSURE P (atm) | 14.5 | 14.5 | 14.5 | 14.5 | 14.5 |
| MAXIMUM INPUT POWER W (WATT) | 70.0 | 35.0 | 50.0 | 90.0 | 110.0 |
| LONGITUDINAL-SECTIONAL CLEARNESS RATIO (%) AFTER FOUR SECONDS | 68% | 52% | 56% | 63% | 65% |
| LUMINOUS FLUX VALUE (lm) AFTER FOUR SECONDS | 1300 | 700 | 900 | 1900 | 2500 |
| LUMINOUS FLUX VALUE x (%) AFTER FOUR SECONDS | 43% | 23% | 30% | 63% | 83% |
| LUMINOUS-INTENSITY-VALUE STANDARD (cd) AFTER FOUR SECONDS: ≥ 6250cd | 6700 | 3300 | 4300 | 9300 | 12300 |
| LUMINOUS INTENSITY VALUE y (%) AFTER FOUR SECONDS | 53% | 25% | 33% | 75% | 100% |
| CLEARNESS PROPORTIONAL VALUE y/x (%) | 123% | 107% | 111% | 118% | 120% |
| RISE (OVERALL EVALUATION INCLUDING CLEARNESS) | O | X | X | O | O |
| CLEARNESS INDEX VALUE $P^2W/\rho$ | 1084 | 542 | 774 | 1393 | 1703 |
| LIFETIME (HOUR) | 2800 | 4000 | 3500 | 2500 | 2000 |
| LIFETIME DURABILITY | O | O | O | O | X |
| OVERALL EVALUATION | O | X | X | O | X |

FIG. 6

| SPECIFICATION/EXAMPLE, COMPARATIVE EXAMPLE | COMPARATIVE EXAMPLE | | | | EXAMPLE ACCORDING TO ASPECT 1 | | | | |
|---|---|---|---|---|---|---|---|---|---|
| | 5-1 | 6-1 | 6-2 | 2-4 | 3-5 | 1-3 | 5-2 | 4-1 | 2-3 |
| OUTER DIAMETER (mm) OF LIGHT EMITTING TUBE | 6.10 | 6.10 | 6.10 | 6.10 | 5.90 | 6.10 | 6.10 | 5.90 | 6.10 |
| INNER DIAMETER (mm) OF LIGHT EMITTING TUBE | 2.50 | 2.50 | 2.50 | 2.50 | 2.30 | 2.50 | 2.50 | 2.30 | 2.50 |
| THICKNESS ((OUTER DIAMETER) - (INNER DIAMETER): mm) | 1.80 | 1.80 | 1.80 | 1.80 | 1.80 | 1.80 | 1.80 | 1.80 | 1.80 |
| INNER VOLUME (CALCULATED FROM INNER DIAMETER OF TUBE) | 22.1 | 22.1 | 22.1 | 22.1 | 18.7 | 22.1 | 22.1 | 18.7 | 22.1 |
| IODIDE AMOUNT (mg) | 0.30 | 0.30 | 0.30 | 0.50 | 0.50 | 0.40 | 0.30 | 0.30 | 0.40 |
| IODIDE DENSITY $\rho$ (mg/cm$^3$) | 13.58 | 13.58 | 13.58 | 22.64 | 26.74 | 18.11 | 13.58 | 16.05 | 18.11 |
| Xe ENCLOSURE PRESSURE P (atm) | 10.0 | 14.5 | 14.5 | 16.0 | 17.5 | 14.5 | 13.0 | 14.5 | 16.0 |
| MAXIMUM INPUT POWER W (WATT) | 70.0 | 35.0 | 50.0 | 70.0 | 70.0 | 70.0 | 70.0 | 70.0 | 70.0 |
| LONGITUDINAL-SECTIONAL CLEARNESS RATIO (%) AFTER FOUR SECONDS | 70% | 52% | 56% | 50% | 52% | 54% | 68% | 65% | 55% |
| LUMINOUS FLUX VALUE (lm) AFTER FOUR SECONDS | 800 | 700 | 900 | 1700 | 1700 | 1400 | 1000 | 1500 | 1600 |
| LUMINOUS FLUX VALUE x (%) AFTER FOUR SECONDS | 31% | 23% | 30% | 52% | 52% | 45% | 37% | 47% | 50% |
| LUMINOUS-INTENSITY-VALUE STANDARD (cd) AFTER FOUR SECONDS: ≥ 6250cd | 4300 | 3300 | 4300 | 6200 | 6500 | 6400 | 6400 | 6500 | 6500 |
| LUMINOUS INTENSITY VALUE y (%) AFTER FOUR SECONDS | 38% | 25% | 33% | 45% | 47% | 49% | 45% | 48% | 48% |
| CLEARNESS PROPORTIONAL VALUE y/x (%) | 125% | 107% | 111% | 88% | 91% | 109% | 123% | 103% | 97% |
| RISE (OVERALL EVALUATION INCLUDING CLEARNESS) | × | × | × | × | △ | △ | △ | △ | △ |
| CLEARNESS INDEX VALUE $P^2W/\rho$ | 515 | 542 | 774 | 792 | 802 | 813 | 871 | 917 | 990 |
| LIFETIME (HOUR) | 3500 | 4000 | 3500 | 2400 | 2500 | 2600 | 3000 | 2800 | 2500 |
| LIFETIME DURABILITY | ○ | ○ | ○ | △ | ○ | ○ | ○ | ○ | ○ |
| OVERALL EVALUATION | × | × | × | × | △ | △ | △ | △ | △ |

FIG. 7 (CONT.)

| SPECIFICATION/EXAMPLE, COMPARATIVE EXAMPLE | EXAMPLE ACCORDING TO ASPECT 3 | | | | | | | | |
|---|---|---|---|---|---|---|---|---|---|
| | 3-4 | BM | 4-2 | 5-3 | 3-3 | 6-3 | 1-2 | 6-4 | 2-2 |
| OUTER DIAMETER (mm) OF LIGHT EMITTING TUBE | 5.90 | 6.10 | 6.30 | 6.10 | 5.90 | 6.10 | 6.10 | 6.10 | 6.10 |
| INNER DIAMETER (mm) OF LIGHT EMITTING TUBE | 2.30 | 2.50 | 2.70 | 2.50 | 2.30 | 2.50 | 2.50 | 2.50 | 2.50 |
| THICKNESS ((OUTER DIAMETER) - (INNER DIAMETER): mm) | 1.80 | 1.80 | 1.80 | 1.80 | 1.80 | 1.80 | 1.80 | 1.80 | 1.80 |
| INNER VOLUME (CALCULATED FROM INNER DIAMETER OF TUBE) | 18.7 | 22.1 | 25.8 | 22.1 | 18.7 | 22.1 | 22.1 | 22.1 | 22.1 |
| IODIDE AMOUNT (mg) | 0.40 | 0.30 | 0.30 | 0.30 | 0.30 | 0.30 | 0.20 | 0.30 | 0.20 |
| IODIDE DENSITY $\rho$ (mg/cm$^3$) | 21.39 | 13.58 | 11.64 | 13.58 | 16.05 | 13.58 | 9.05 | 13.58 | 9.05 |
| Xe ENCLOSURE PRESSURE P (atm) | 17.5 | 14.5 | 14.5 | 16.0 | 17.5 | 14.5 | 14.5 | 14.5 | 16.0 |
| MAXIMUM INPUT POWER W (WATT) | 70.0 | 70.0 | 70.0 | 70.0 | 70.0 | 90.0 | 70.0 | 110.0 | 70.0 |
| LONGITUDINAL-SECTIONAL CLEARNESS RATIO (%) AFTER FOUR SECONDS | 56% | 68% | 78% | 70% | 69% | 63% | 80% | 65% | 78% |
| LUMINOUS FLUX VALUE (lm) AFTER FOUR SECONDS | 1600 | 1300 | 1200 | 1500 | 1500 | 1900 | 1200 | 2500 | 1400 |
| LUMINOUS FLUX VALUE x (%) AFTER FOUR SECONDS | 50% | 43% | 43% | 47% | 47% | 63% | 41% | 83% | 47% |
| LUMINOUS-INTENSITY-VALUE STANDARD (cd) AFTER FOUR SECONDS: ≥6250cd | 6800 | 6700 | 6600 | 7800 | 7000 | 9300 | 6800 | 12300 | 7200 |
| LUMINOUS INTENSITY VALUE y (%) AFTER FOUR SECONDS | 51% | 53% | 56% | 59% | 52% | 75% | 56% | 100% | 58% |
| CLEARNESS PROPORTIONAL VALUE y/x (%) | 102% | 123% | 131% | 125% | 112% | 118% | 135% | 120% | 123% |
| RISE (OVERALL EVALUATION INCLUDING CLEARNESS) | ○ | ○ | ○ | ○ | ○ | ○ | ○ | ○ | ○ |
| CLEARNESS INDEX VALUE $P^2W/\rho$ | 1002 | 1084 | 1264 | 1319 | 1336 | 1393 | 1625 | 1703 | 1979 |
| LIFETIME (HOUR) | 2500 | 2800 | 3000 | 2800 | 2600 | 2500 | 2800 | 2000 | 2600 |
| LIFETIME DURABILITY | ○ | ○ | ○ | ○ | ○ | ○ | ○ | × | ○ |
| OVERALL EVALUATION | ○ | ○ | ○ | ○ | ○ | ○ | ○ | × | ○ |

(FIG. 7 CONTINUED)

| SPECIFICATION/EXAMPLE, COMPARATIVE EXAMPLE | EXAMPLE ACCORDING TO ASPECT 1 | | | | |
|---|---|---|---|---|---|
| | 3-2 | 5-4 | 1-1 | 2-1 | 3-1 |
| OUTER DIAMETER (mm) OF LIGHT EMITTING TUBE | 5.90 | 6.10 | 6.10 | 6.10 | 5.90 |
| INNER DIAMETER (mm) OF LIGHT EMITTING TUBE | 2.30 | 2.50 | 2.50 | 2.50 | 2.30 |
| THICKNESS ((OUTER DIAMETER) - (INNER DIAMETER): mm) | 1.80 | 1.80 | 1.80 | 1.80 | 1.80 |
| INNER VOLUME (CALCULATED FROM INNER DIAMETER OF TUBE) | 18.7 | 22.1 | 22.1 | 22.1 | 18.7 |
| IODIDE AMOUNT (mg) | 0.20 | 0.30 | 0.10 | 0.10 | 0.10 |
| IODIDE DENSITY $\rho$ (mg/cm$^3$) | 10.70 | 13.58 | 4.53 | 4.53 | 5.35 |
| Xe ENCLOSURE PRESSURE P (atm) | 17.5 | 20.0 | 14.5 | 16.0 | 17.50 |
| MAXIMUM INPUT POWER W (WATT) | 70.0 | 70.0 | 70.0 | 70.0 | 70.0 |
| LONGITUDINAL-SECTIONAL CLEARNESS RATIO (%) AFTER FOUR SECONDS | 84% | 69% | 90% | 92% | 93% |
| LUMINOUS FLUX VALUE (lm) AFTER FOUR SECONDS | 1500 | 1900 | 1100 | 1300 | 1400 |
| LUMINOUS FLUX VALUE x (%) AFTER FOUR SECONDS | 48% | 56% | 41% | 48% | 50% |
| LUMINOUS-INTENSITY-VALUE STANDARD (cd) AFTER FOUR SECONDS: ≥6250cd | 7400 | 9700 | 6700 | 7100 | 7400 |
| LUMINOUS INTENSITY VALUE y (%) AFTER FOUR SECONDS | 57% | 69% | 59% | 63% | 63% |
| CLEARNESS PROPORTIONAL VALUE y/x (%) | 118% | 124% | 145% | 131% | 127% |
| RISE (OVERALL EVALUATION INCLUDING CLEARNESS) | ○ | ○ | ○ | ○ | ○ |
| CLEARNESS INDEX VALUE $P^2W/\rho$ | 2004 | 2062 | 3251 | 3958 | 4008 |
| LIFETIME (HOUR) | 2400 | 2100 | 2000 | 2100 | 2000 |
| LIFETIME DURABILITY | △ | △ | × | △ | × |
| OVERALL EVALUATION | △ | △ | × | △ | × |

FIG. 11A IMMEDIATELY AFTER LAMP-ON TIMING
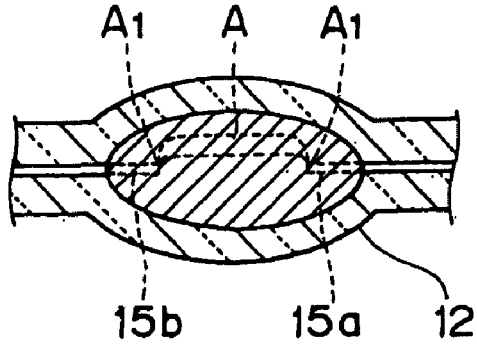
FIG. 11B AFTER FOUR SECONDS FROM LAMP-ON TIMING
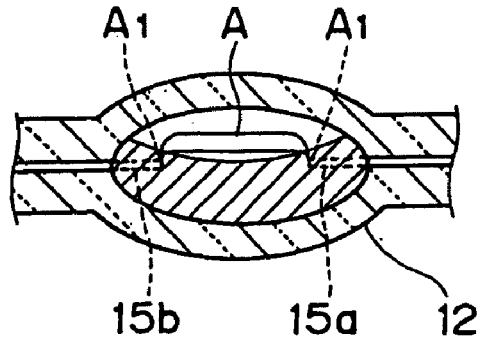
FIG. 11C AFTER TEN SECONDS FROM LAMP-ON TIMING
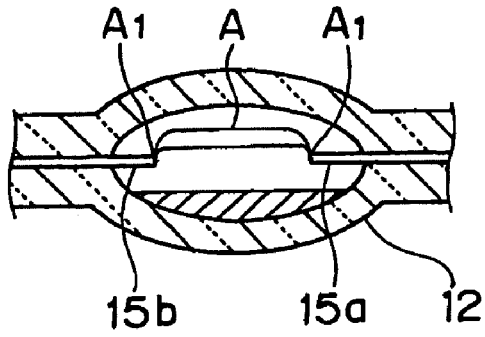

MERCURY-FREE ARC TUBE FOR DISCHARGE LAMP UNIT

This application claims priority from Japanese Patent Application Nos. 2008-030735, filed on Feb. 12, 2008, and 2009-017199, filed on Jan. 28, 2009, the entire contents of which are hereby incorporated by reference.

BACKGROUND

1. Technical Field

Apparatuses consistent with the present invention relate to mercury-free arc tubes for use in discharge lamp units, and more particularly, to mercury-free arc tubes having an increased luminous intensity rise.

2. Description of Related Art

In a related-art discharge lamp unit used as a light source of a vehicle lamp, a discharge bulb has a structure in which an arc tube having a sealed glass bulb forming a sealed chamber as a light emitting portion is integrally formed with an electrically insulating plug body made of a synthetic resin. For example, a rear end portion of the arc tube is supported by a metal support member fixed to the electrically insulating plug body. A front end portion of the arc tube is attached to a metal lead support serving as a current conduction path extending from the electrically insulating plug body.

The related-art arc tube has a structure in which a main light emitting metal halide (e.g., Na, Sc, or the like), mercury, and a starting rare gas (e.g., Xe gas or the like) are enclosed in the sealed glass bulb provided with a pair of electrodes. Light is emitted by an arc generated by an electric discharge between the electrodes.

The mercury in the sealed glass bulb acts as a buffer substance. The mercury keeps the tube voltage constant in order to reduce the amount of electrons colliding with the electrodes to thereby reduce damage caused by the electrodes. Also, the mercury acts as a light emitting substance for emitting white light. However, the related-art discharge lamp unit has a disadvantage in that mercury is a substance which is highly toxic to the environment. In response to the social needs of reducing the cause of global environmental pollution, it is advantageous to develop a mercury-free arc tube.

JP-A-2003-168391 describes a mercury-free arc tube which is able to obtain a characteristic similar to that of a mercury containing arc tube. The related art mercury-free arc tube adopts a configuration in which a main light emitting metal halide (e.g., Na or Sc) and a buffer metal halide e.g., Zn) are enclosed in a sealed glass bulb. The buffer metal halide is selected as a substitute for mercury to serve as a buffer substance. A pressure of an enclosed starting rare gas (Xe gas) is adjusted to be high.

However, the structure described in JP-A-2003-168391 also has some disadvantages. For example, although a luminous flux rise is improved to some extent, the luminous flux rise is slower than that of the mercury containing arc tube. In the mercury containing arc tube, an output of 80% is obtained after four seconds from a time when light is emitted by Hg (i.e., the luminous flux rise is fast), but in the mercury-free arc tube, an output of 25% is obtained after four seconds in the case of using Na or Sc (i.e., the luminous flux rise is slow). In a vehicle head lamp, a luminous intensity rise standard (e.g., 6520 cd or more after four seconds from a lamp-on timing) is set at a certain light distribution point. However, in the related art mercury-free arc tube described in JP-A-2003-168391, the luminous intensity rise of the head lamp using the related art mercury-free arc tube as the light source is slow since the luminous flux rise is slow.

SUMMARY OF THE INVENTION

Exemplary embodiments of the present invention address the above disadvantages and other disadvantages not described above. However, the present invention is not required to overcome the disadvantages described above, and thus, an exemplary embodiment of the present invention may not overcome any disadvantages described above.

Accordingly, it is an aspect of the present invention to provide a mercury-free arc tube capable of obtaining a characteristic substantially similar to that of a mercury containing arc tube and particularly capable of improving a luminous intensity rise of a head lamp.

According to an exemplary embodiment of the present invention, there is provided a mercury-free arc tube for a discharge lamp unit, the mercury-free arc tube comprising a plurality of electrodes and a sealed chamber comprising a metal halide and a starting rare gas enclosed therein. A clearness index value $P^2 \cdot W/\rho$ is equal to or greater than about 800, where $\rho$ denotes a density ($mg/cm^3$) of the enclosed metal halide, P denotes a pressure (atmospheres) of the enclosed starting rare gas, and W denotes a maximum input power (watts) input to the sealed chamber through the electrodes.

According to another exemplary embodiment of the present invention, there is provided a mercury-free arc tube for a discharge lamp, the mercury-free arc tube comprising two electrodes; and a sealed chamber in which a metal halide comprising at least Na and Sc is enclosed together with Xe gas serving as starting rare gas, wherein a clearness index value $P^2 \cdot W/\rho$ is equal to or greater than about 800, where $\rho$ denotes a density ($mg/cm^3$) of the enclosed metal halide, P denotes a pressure (atmospheres) of the enclosed Xe gas, and W denotes a maximum input power (watts).

BRIEF DESCRIPTION OF THE DRAWINGS

FIGS. 3A to 3C are views showing a state of a fog occurring in a sealed glass bulb of the mercury-free arc tube according to the first exemplary embodiment, wherein FIG. 3A is a schematic view of the mercury-free arc tube showing a state where the fog occurs in a tube wall just after a lamp-on timing (i.e., a time when the lamp is turned on), FIG. 3B is a schematic view of the mercury-free arc tube showing the fog after four seconds from the lamp-on timing, and FIG. 3C is a schematic view of the mercury-free arc tube showing the fog after ten seconds from the lamp-on timing;

FIG. 4 is a table showing experimental results for thirteen types of the mercury-free arc tubes including groups 1 to 3 having different specifications in addition to one standard specification;

FIG. 5 is a table showing experimental results for ten types of the mercury-free arc tubes including groups 4 to 6 having different specifications;

FIG. 6 is a table in which the experimental results for nine types of the mercury-free arc tubes having different specifications are arranged in order of a clearness index value and are shown as Comparative Example and Example;

FIG. 7 is a table in which the experimental results for fourteen types of the mercury-free arc tube having different specifications are arranged in order of the clearness index value and are shown as the Example;

FIGS. 8A to 8F are experimental results, wherein FIG. 8A shows a relationship between the weight of the enclosed metal halide and the longitudinal-sectional clearness ratio of the sealed glass bulb after four seconds from the lamp-on timing, FIG. 8B shows a relationship between the Xe enclosure pressure and the longitudinal-sectional clearness ratio of the sealed glass bulb after four seconds from the lamp-on timing, FIG. 8C shows a relationship between the maximum input power and the longitudinal-sectional clearness ratio of the sealed glass bulb after four seconds from the lamp-on timing, FIG. 8D shows a relationship between the inner diameter (the inner diameter at a position in the middle of the electrodes) of the sealed glass bulb and the longitudinal-sectional clearness ratio of the sealed glass bulb after four seconds from the lamp-on timing, FIG. 8E shows a relationship between the density of the enclosed metal halide and the longitudinal-sectional clearness ratio of the sealed glass bulb after four seconds from the lamp-on timing, and FIG. 8F shows a relationship between the square value of the Xe enclosure pressure and the longitudinal-sectional clearness ratio of the sealed glass bulb after four seconds from the lamp-on timing.

FIGS. 9A to 9F are experimental results, wherein FIG. 9A shows a relationship between the clearness index value $P^2 \cdot W/\rho$ and the weight of the enclosed metal halide, FIG. 9B shows a relationship between the clearness index value $P^2 \cdot W/\rho$ and the pressure of the enclosed Xe gas, FIG. 9C shows a relationship between the clearness index value $P^2 \cdot W/\rho$ and the maximum input power, FIG. 9D shows a relationship between the clearness index value $P^2 \cdot W/\rho$ and the inner diameter (the inner diameter at a position in the middle of the electrodes) of the sealed glass bulb, FIG. 9E shows a relationship between the clearness index value $P^2 \cdot W/\rho$ and the density of the enclosed metal halide, and FIG. 9F shows a relationship between the clearness index value $P^2 \cdot W/\rho$ and the square value of the Xe enclosure pressure.

FIGS. 11A to 11C are views showing a state of a fog occurring in a sealed glass bulb of the mercury-free arc tube according to the related art, wherein FIG. 11A is a schematic view of the related art mercury-free arc tube showing a state where the fog occurs in a tube wall immediately after a lamp-on timing, FIG. 11B is a schematic view of the related art mercury-free arc tube showing the fog after four seconds from the lamp-on timing, and FIG. 11C is a schematic view of the related art mercury-free arc tube showing the fog after ten seconds from the lamp-on timing.

DETAILED DESCRIPTION OF EXEMPLARY EMBODIMENTS OF THE INVENTION

Figure 10:
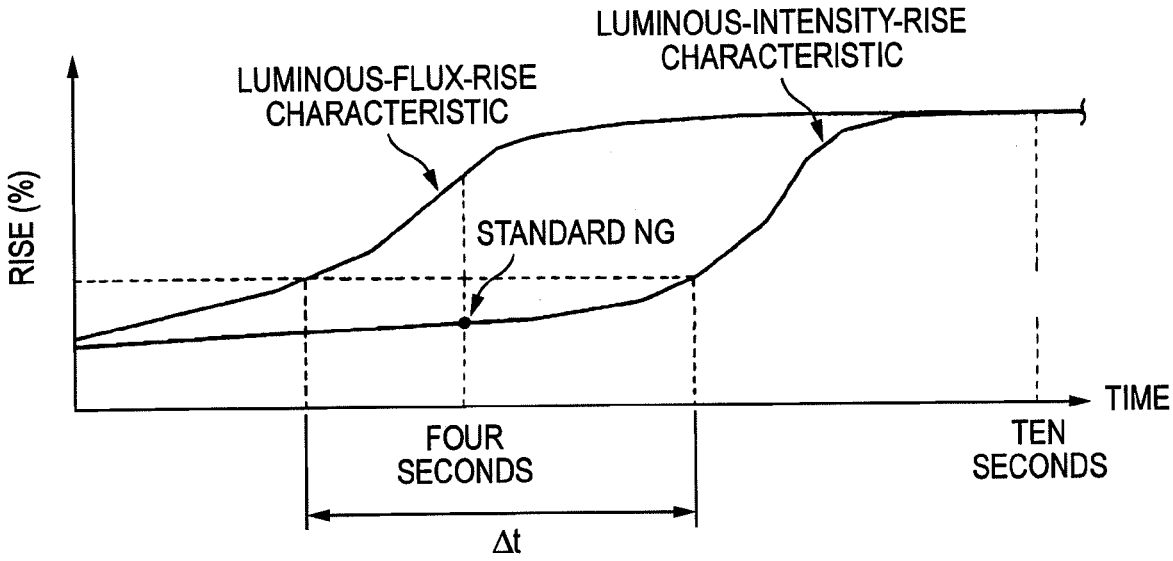
FIG. 10 is a diagram showing a time difference (deviation) between a luminous flux rise of the mercury-free arc tube according to the related art and a luminous intensity rise of a head lamp using the related art mercury-free arc tube as a light source.

As discussed above, in a head lamp using a related art mercury-free arc tube described in JP-A-2003-168391, the luminous intensity rise of the head lamp using the related art mercury-free arc tube as the light source is slow since the luminous flux rise is slow. As is shown in FIG. 10, there is a considerable time difference (i.e., deviation) Δt between the luminous flux rise of the mercury-free arc tube and the luminous intensity rise of the head lamp, and the large time difference (deviation) Δt further delays the luminous intensity rise of the head lamp, that is, the luminous intensity rise standard of the head lamp cannot be satisfied due to the large time difference.

Accordingly, the present inventors examined a mechanism by which the time difference (deviation) Δt occurs, and discovered that the luminous intensity rise start is slow because metal halogen molecules evaporate immediately after the lamp is turned on and then adhere to a whole portion of a tube wall. The adhered metal halogen molecules generate a type of fog that makes the glass of the sealed glass bulb temporarily opaque, and the luminous intensity of the arc does not increase until the fog is cleared.

That is, the enclosed metal halide is accumulated in a bottom portion of the sealed glass bulb in a solid state before the head lamp is turned on, but is instantly evaporated by a starting pulse transmitted along the tube wall of the sealed glass bulb at the same time when the head lamp is turned on. The evaporated metal halide makes contact with the tube wall having a low temperature and is solidified thereto to thereby make the whole portion of the sealed glass bulb obscured like in an opaque glass state shown in FIG. 11A, thereby reducing a luminance of the light emission (luminous flux) of an arc A generated between the electrodes. For this reason, the arc (luminous flux) is generated between the electrodes, but the luminous intensity of the head lamp hardly increases. Then, when the arc A becomes stable to make the tube wall warm, the metal halides solidified in a surface of the tube wall is evaporated, and the fog of the sealed glass bulb becomes clear gradually from the upside.

Specifically, since a temperature at a position closer to the upper portion of the sealed glass bulb is large and a convection current is active after four seconds from the lamp-on timing, the fog of the upper portion of the tube wall becomes clear first as shown in FIG. 11B, but the side portion of the tube wall is still obscured (i.e., the metal halide is adhered to the side portion of the tube wall in a solidified state). Since a luminous point A1 of the arc A is hidden due to the fog (i.e., the metal halide solidified in the side portion of the tube wall) still left in the side portion of the tube wall, the luminance of the light emission (luminous flux) of the arc A slightly increases more than at a point at which the lamp is turned on, but is still low. Particularly, the upper portion of the tube wall is clear, but the side portion (i.e., in the traverse direction) of the luminous point A1 of the arc A positioned at the upper front end portion of the electrode is still unclear with respect to a reflector for reflecting the light emitted from the arc tube. For this reason, the luminance of the arc (luminous flux) does not increase. As a result, it is not possible to satisfy the standard for luminous intensity for the head lamp.

Then, after ten seconds from the lamp-on timing, all the metal halide solidified in the side portion of the tube wall is sublimated, as shown in FIG. 11C. Thus, the fog is removed from the sealed glass bulb and thereby the luminance of the arc (luminous flux) is increased, and a state is reached where the head lamp is capable of reliably obtaining a substantially uniform luminous intensity.

Therefore, it is advantageous for the fog occurring in the sealed glass bulb immediately after tuning on the lamp to be vanished as quickly as possible in order to improve a luminous-intensity-rise characteristic of the head lamp. Additionally, it is advantageous if the improvement of the luminous intensity rise of the head lamp is realized in a state where the luminous point A1 of the arc A can be clearly seen (visibly recognized) from the side portion of the sealed glass bulb before four seconds from the time the lamp is turned on. In other words, when an upper edge of an obscured region is positioned below the luminous point of the arc, the luminance in the side potion (traverse direction) of the light emission (luminous flux) of the arc increases, and the time difference (deviation) between the luminous flux rise of the mercury-free arc tube and the luminous intensity rise of the head lamp is reduced.

The inventors prepared mercury-free arc tubes having different densities of the enclosed metal halide and pressures of the enclosed starting rare gas (Xe gas) for a test. A maximum input power (i.e., a maximum input power supplied from a ballast to the arc tube for four or five seconds at the time of the luminous flux rise) of a ballast was changed, and evaluation data was obtained from a given light distribution point after four seconds at the time of the luminous intensity rise. As can be seen from FIGS. 8A to 8C, 8E and 8F, the inventors discovered that a longitudinal-section clearness ratio (i.e., a clearness degree of the sealed glass bulb when viewed from the side portion, which shows a degree that the upper edge of the obscure region decreases in a vertical direction) of the sealed glass bulb after four second is almost in inverse proportion to a density ρ ($mg/cm^3$) of the enclosed metal halide and is almost in proportion to the square of a pressure P (atmosphere) of the Xe gas and a maximum input power W (watt).

Figure 8A:
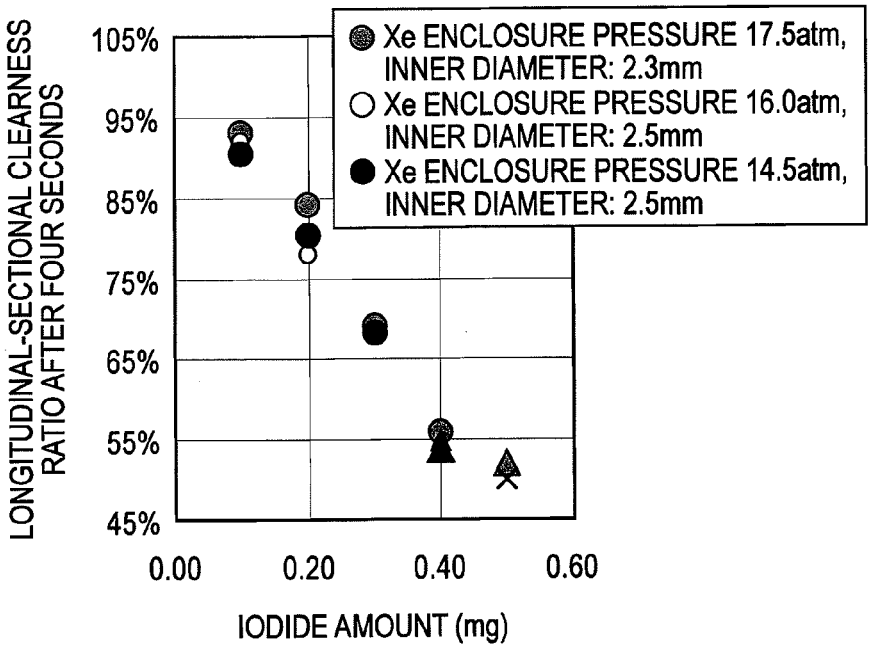
Figure 8B:
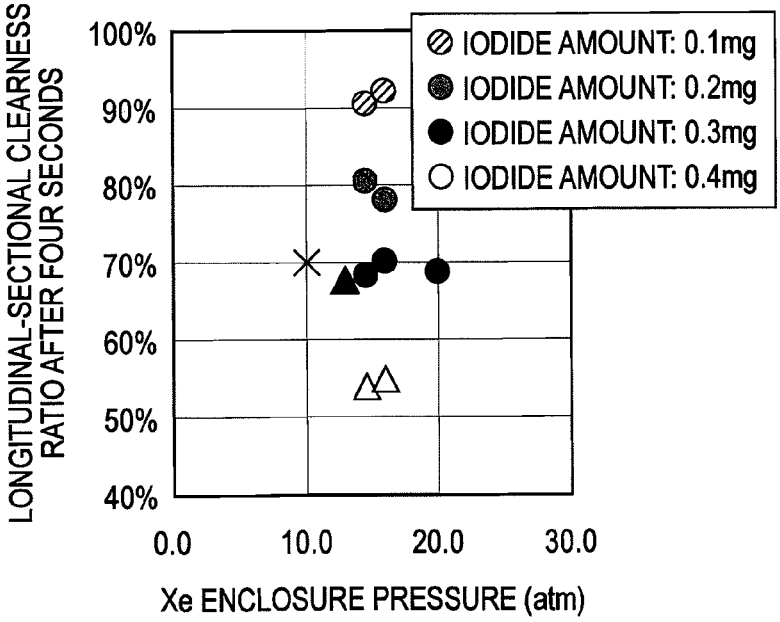
Figure 8C:
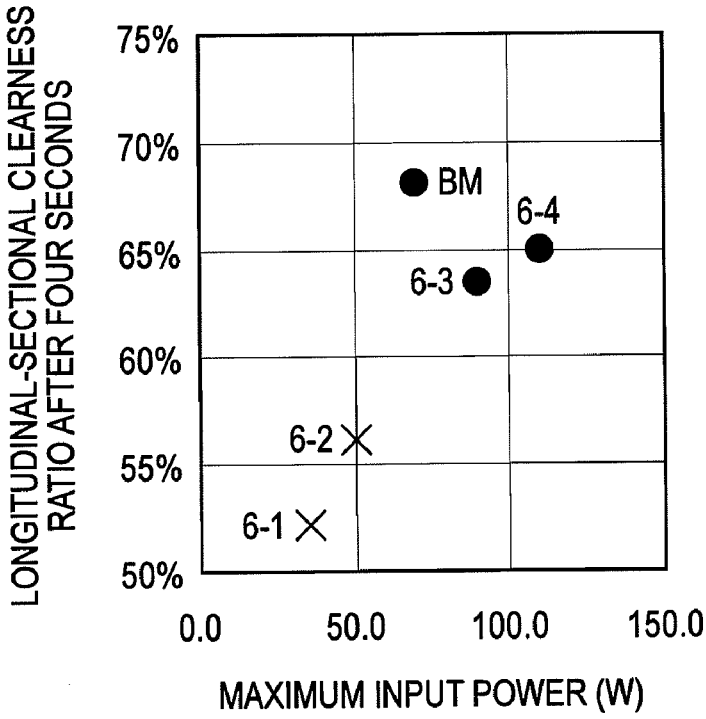
Figure 8D:
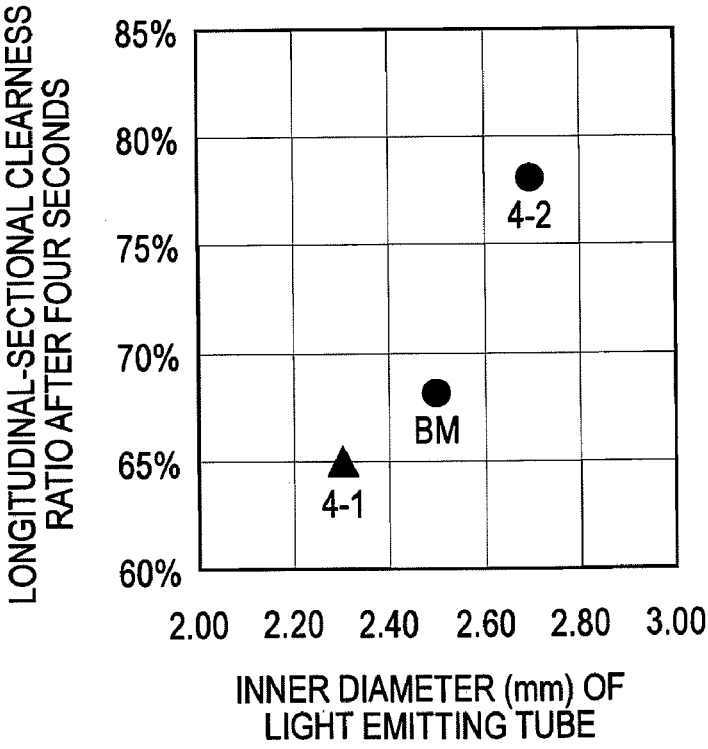
Figure 8E:
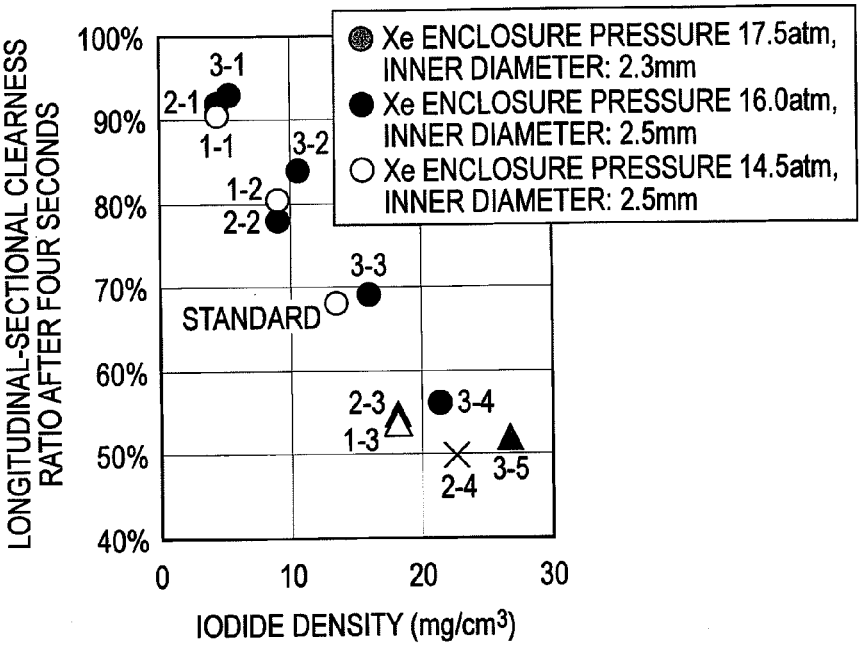

As shown in FIG. 8E, the clearness ratio is influenced by the density ρ (on the basis of the data, the clearness ratio is almost in inverse proportion to the density ρ) because the amount of the metal halide evaporated immediately after tuning on the arc tube is large. Thereby, the metal halide adhered to the tube wall is thickened when the density ρ (an amount of the enclosed metal halide) of the metal halide is high (large).

Figure 8F:
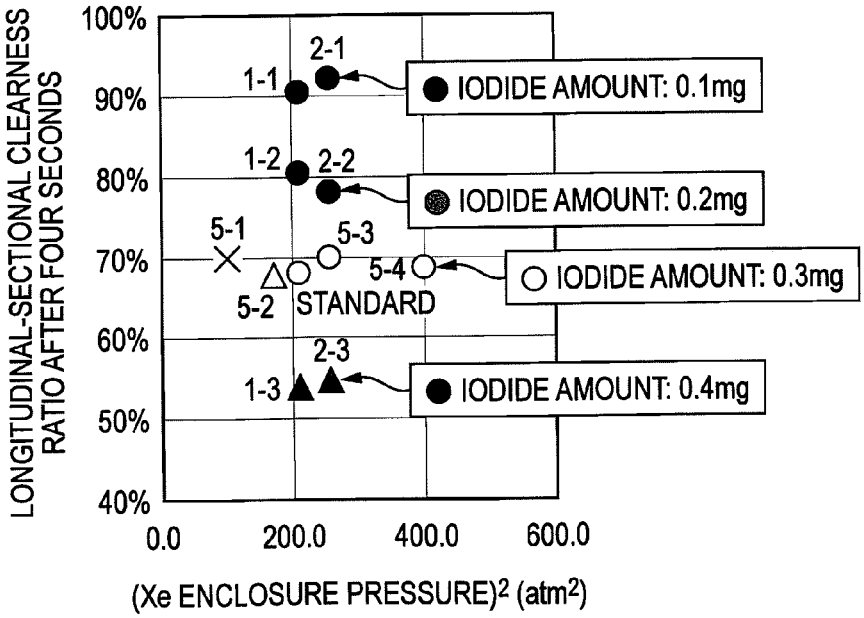

Additionally, as shown in FIG. 8F, the clearness ratio is influenced by the pressure P of the Xe gas (on the basis of the data, the clearness ratio is almost in proportion to the square of the pressure) because a light emitting amount (heating amount) immediately after turning on the arc tube is large. Thereby the temperature in the sealed glass bulb is increased when the pressure P (atmosphere) of the Xe gas is large.

Further, as shown in FIG. 8C, the clearness ratio is influenced by the maximum input power (on the basis of the data, the clearness ratio is in proportion to the maximum input power) because the light emitting amount (heating amount) immediately after turning on the arc tube is large. Thereby the temperature in the sealed glass bulb is increased when the maximum input power is large.

Therefore, an equation "$P^2 \cdot W/\rho$" (hereinafter, referred to as "a clearness index value") was obtained and examined. In the equation, ρ denotes a density ($mg/cm^3$) of the enclosed metal halide, P denotes a pressure (atmosphere) of the Xe gas, and W denotes the maximum input power (watts). The inventors then discovered, from FIGS. 6 and 7, that the luminous intensity rise of the head lamp is improved when "the clearness index value" is a threshold value or more (i.e., the fog of at least the upper half portion of the sealed glass bulb vanishes within four seconds from the time the lamp is turned on to thereby reduce the time difference (deviation) Δt between the luminous flux rise of the bulb (arc tube) and the luminous intensity rise of the head lamp).

Exemplary embodiments of the present invention will be now described with reference to the drawings.

Figure 1:
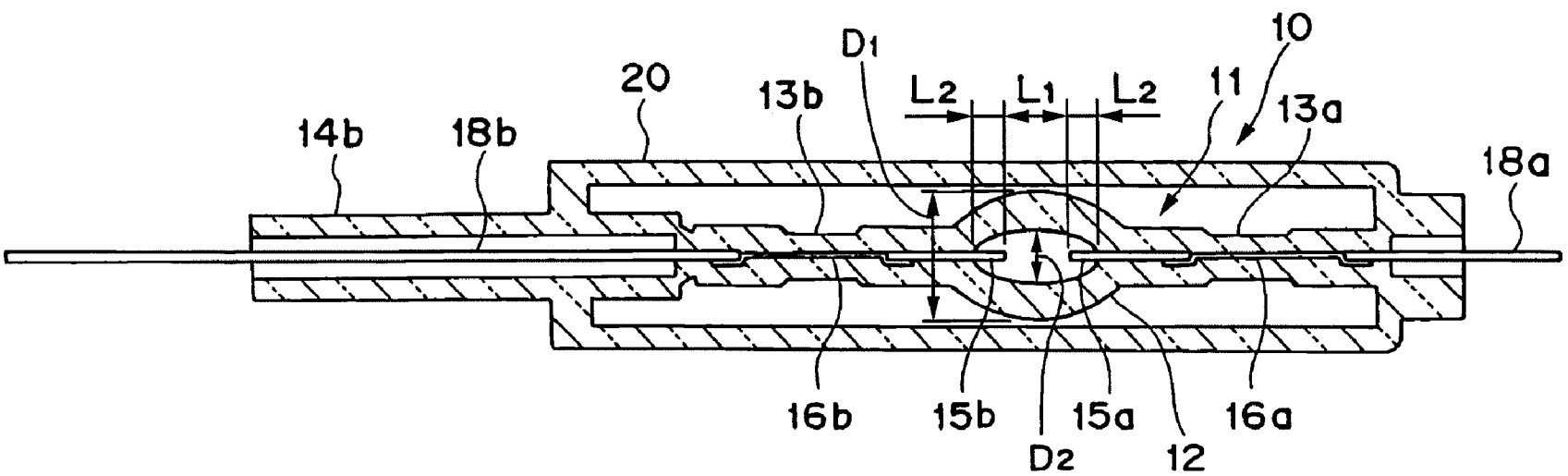
FIG. 1 is a longitudinal-sectional view showing a mercury-free arc tube for a discharge lamp unit according to a first exemplary embodiment of the present invention.

In FIG. 1, an arc tube 10 is formed into a structure in which an ultraviolet-light-shield cylindrical shroud glass 20 is integrally weld-adhered (seal-adhered) to an arc tube body 11 having a sealed glass bulb 12 as a sealed chamber provided with a pair of electrodes 15*a* and 15*b*, and the sealed glass bulb 12 is sealed by the ultraviolet-light-shield cylindrical shroud glass 20 in a surrounding manner.

The arc tube body 11 is formed by a cylindrical pipe-shaped quartz glass tube, and is formed into a structure in which the rotary-oval-shaped sealed glass bulb 12 is formed at the substantial center in a longitudinal direction so as to be interposed between pinch seal portions 13*a* and 13*b* formed in a rectangular shape in a sectional view. Rectangular molybdenum films 16*a* and 16*b* are seal-adhered to the pinch seal portions 13*a* and 13*b*, respectively. One-side portions of the molybdenum films 16*a* and 16*b* are respectively connected to a pair of tungsten electrodes 15*a* and 15*b* in the sealed glass bulb 12, and the other-side portions thereof are respectively connected to lead wires 18*a* and 18*b* drawn outward from the arc tube body 11.

A cylindrical pipe-shaped rear extending portion 14*b* as a non-pinch seal portion is formed in an end portion of the arc tube body 11 in a coaxial shape so as to protrude backward from the shroud glass 20. The shroud glass 20 is configured as a quartz glass doped with $TiO_2$, $CeO_2$, or the like and exhibits an ultraviolet light shielding effect, thereby reliably cutting off the ultraviolet light in a wavelength range which is generated by the light emission of the sealed glass bulb 12 as a discharge light emitting portion and is harmful to a human body. The wavelength range may be predetermined.

A starting rare gas (Xe gas), a main light emitting metal halide (NaI, $ScI_3$), and a buffer metal halide ($ZnI_2$) are enclosed in the sealed glass bulb 12. The buffer metal halide ($ZnI_2$) is a buffer substance substituted for mercury. A pressure of the enclosed starting rare gas (Xe gas) is set to about 13 to about 20 atmosphere (in this exemplary embodiment, the pressure is set to 14.5 atmosphere), thereby forming the mercury-free arc tube exhibiting a characteristic substantially similar to that of the mercury containing arc tube.

That is, NaI and $ScI_3$ as the main light emitting metal halide are substances mainly contributing to light emission. $ZnI_2$ as the buffer metal halide acts as a buffer substance to suppress a reduction in a tube voltage. $ZnI_2$ is used instead of mercury enclosed in the related art arc tube and also acts as a light emitting substance substituted for mercury. Particularly, since the pressure of the enclosed starting rare gas (Xe gas) is a comparatively large pressure (14.5 atmosphere), a ratio at which electrons, released from the electrodes 15*a* and 15*b* at electrical discharge, collide with molecules of the rare gas increases. As a result, a temperature of the inside of the sealed glass bulb 12 at a lamp-on timing (at an electrical discharge timing) becomes large to thereby increase a vapor pressure of the main light emitting metal halide and the buffer metal halide and to thereby increase the tube voltage, thereby obtaining a value substantially equal to the tube voltage of the related art mercury containing arc tube and obtaining the substantially same whiteness (chromaticity) as the light emitting color of the related art mercury containing arc tube.

$ZnI_2$ is used in the first exemplary embodiment. However, alternatively, at least one or more metal halide selected from Al, Bi, Cr, Cs, Fe, Ga, In, Mg, Ni, Nd, Sb, Sn, Tb, Tl, Ti, Li, and Zn may be employed as a buffer metal halide enclosed together with NaI and $ScI_3$.

A total amount of the enclosed metal halide (NaI, $ScI_3$, and $ZnI_2$) is about 0.30 mg, and an amount of the buffer metal halide ($ZnI_2$) is about 0.027 mg in the total enclosure amount. Additionally, a weight ratio between NaI and $ScI_3$ is from about 70 to about 30.

An outer diameter D1 (see FIG. 1) at a position in the middle of the electrodes of the sealed glass bulb 12 is set to about 6.10 mm, and an inner diameter D2 thereof is set to about 2.50 mm (i.e., a thickness of a tube wall is set to about 1.8 mm). An inner volume of the sealed glass bulb 12 is set to about 22.1 $mm^3$ (22.1 μl), and a density ρ of the enclosed metal halide (NaI, $ScI_3$, and $ZnI_2$) is set to about 13.58 $mg/cm^3$.

A distance L1 between the electrodes is advantageously set to be in a range of about 4.0 mm to about 4.4 mm. This range is the same range as that of the related art mercury containing arc tube, and a length L2 of the electrode protruding to the inside of the sealed glass bulb 12 is advantageously set to be in the range of about 1.0 to about 2.0 mm. An inert gas having a pressure of about 1 atmosphere or less is enclosed in the shroud glass 20, thereby exhibiting a heat insulation function against heat radiation from the sealed glass bulb 12 which is an electric discharge portion.

Figure 2:
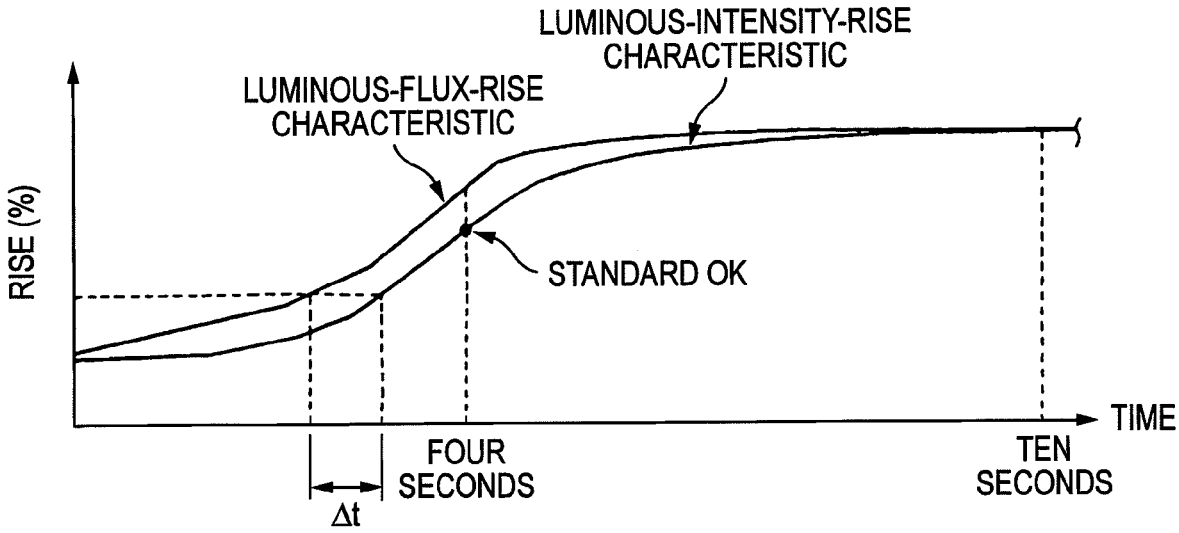
FIG. 2 is a diagram showing a time difference (deviation) between a luminous flux rise of the mercury-free arc tube according to the first exemplary embodiment and a luminous intensity rise of a head lamp using the mercury-free arc tube as a light source.

Additionally, in a head lamp using a discharge bulb provided with the mercury-free arc tube 10 according to the first exemplary embodiment as a light source, when the mercury-free arc tube 10 is turned on, as shown in FIG. 2, a luminous flux of the mercury-free arc tube 10 gradually rises to thereby move to an electric discharge state capable of obtaining a substantially uniform luminous flux, and a luminous intensity of the head lamp rises at a timing slightly slower than a timing when the luminous flux of the mercury-free arc tube 10 rises to thereby obtain a substantially uniform luminous intensity substantially corresponding to the uniform luminous flux of the mercury-free arc tube 10. A delay (deviation) Δt between the luminous flux rise of the mercury-free arc tube according to the first exemplary embodiment and the luminous intensity rise of the head lamp using the mercury-free arc tube according to the first exemplary embodiment is shorter compared with the related art head lamp using the related art discharge bulb provided with the related art arc tube described in JP-A-2003-168391 as the light source.

That is, in the mercury-free arc tube according to the first exemplary embodiment of the present invention, the enclosed metal halide, accumulated in a bottom portion of the sealed glass bulb 12 in a solid state before the head lamp is turned on, is instantly evaporated by a starting pulse transmitted along the tube wall of the sealed glass bulb 12 at the same time when the head lamp is turned on. The evaporated metal halide makes contact with the tube wall having a low temperature to be solidified (adhered) thereto to thereby make the whole portion of the sealed glass bulb 12 obscured in an opaque glass state as shown in FIG. 3A, thereby reducing a luminance of the light emission (luminous flux) of an arc A generated between the electrodes 15*a* and 15*b*. For this reason, the arc (luminous flux) is generated between the electrodes 15*a* and 15*b*, but the luminous intensity of the head lamp does not increase much. A luminous intensity characteristic of the head lamp immediately after tuning on the head lamp is the same as the luminous intensity characteristic (see FIG. 10) of the related art head lamp using the related art mercury-free arc tube described in JP-A-2003-168391 as the light source.

Since a temperature at a position closer to the upper portion of the sealed glass bulb 12 is large and a convection current is active after four seconds from the lamp-on timing, the metal halide solidified and adhered to the upper portion of the tube wall is gradually sublimated as shown in FIG. 3B to thereby clear the obscured upper portion of the tube wall, but the side portion of the tube wall is still obscured (i.e., the metal halide is adhered to the side portion of the tube wall). However, a clearness index value "$P^2 \cdot W/\rho$" set by a density ρ ($mg/cm^3$) of the enclosed metal halide in the sealed glass bulb 12, a pressure P (atmosphere) of the enclosed Xe gas, and a maximum input power W (watt) is not less than a lower limit value of about 800 satisfying a condition that an upper edge of an obscure region after four seconds from the lamp-on timing is positioned below a luminous point of the arc so that a luminous intensity value of the head lamp after four seconds from the lamp-on timing is not less than 6250 cd as a standard value. Accordingly, after four seconds, a state is achieved where a luminous point A1 of the arc A can be clearly seen (visibly recognized) from the side portion of the sealed glass bulb 12. As a result, a luminance of the light emission (luminous flux) of the arc A in the side portion of (i.e., in a traverse direction of) the sealed glass bulb 12 increases, and a time difference (deviation) Δt between the luminous flux rise of the mercury-free arc tube and the luminous intensity rise of the head lamp is reduced as shown in FIG. 2, thereby satisfying the luminous intensity rise standard (i.e., 6250 cd or more after four seconds from the lamp-on timing) of the head lamp.

Subsequently, the fog of the sealed glass bulb 12 becomes clear gradually in a downward direction within the tube with the passage of time, and hence, the luminous intensity of the head lamp increases (i.e., the luminous intensity of the head lamp rises in a manner similar to the luminous-flux-rise characteristic of the arc). Then, after ten seconds from the lamp-on timing, all the metal halide solidified and adhered to the side portion of the tube wall is sublimated as shown in FIG. 3C to thereby completely remove the fog of the sealed glass bulb 12 and to thereby increase the luminance of the arc (luminous flux) in a whole circumferential direction, thereby moving to a state where the head lamp is capable of reliably obtaining the substantially uniform luminous intensity as shown in FIG. 2.

FIGS. 4 and 5 are tables showing experiment results for each of a plurality of groups, where the experiment results are a clearness ratio (%) after four seconds from the lamp-on timing, a luminous flux value after four seconds from the lamp-on timing, a luminous intensity value after four seconds from the lamp-on timing, a clearness index value "$P^2 \cdot W/\rho$", a lifetime, and the like; and the groups show the mercury-free arc tube provided with twenty three specifications including three arc tubes of group 1, four arc tubes of group 2, five arc tubes of group 3, two arc tubes of group 4, four arc tubes of group 5, four arc tubes of group 6 in addition to one arc tubes of a standard specification indicated by BM. FIGS. 6 and 7 are tables in which the experiment results shown in FIGS. 4 and 5 are arranged in order of a size of the clearness index value "$P^2 \cdot W/\rho$", and are divided into Example and Comparative Example. For example, like "the group 3-3" shown in FIG. 4 and "the Example 3-3" shown in FIG. 7, the numbers of the groups 1 to 6 shown in FIGS. 4 and 5 correspond to the numbers of Examples and Comparative Examples 1 to 6 shown in FIGS. 6 and 7.

Here, an inner volume ($mm^3$) of a light emitting tube (sealed glass bulb) is calculated from the inner diameter at the position in the middle of the electrodes of the sealed glass bulb, and there are three different volumes: 18.7, 22.1, and 25.8 $mm^3$.

Additionally, regarding the density ρ ($mg/cm^3$) of the enclosed density of the metal halide (NaI, $ScI_3$, and $ZnI_2$), there are eleven different densities ranging from 4.53 to 26.74 $mg/cm^3$, and the ratio of $ZnI_2$ with respect to the total amount of the metal halide for each mercury-free arc tube is 9%.

Regarding the pressure P (atmosphere) of the enclosed Xe gas, there are six different pressures from 10.0 to 20.0 (atmosphere). Regarding the maximum input power (watt), there are five different powers from 35 to 110.

The longitudinal-sectional clearness ratio (%) after four seconds from the lamp-on timing denotes a value showing a vertical position of the upper edge of the obscure region left in the sealed glass bulb after four seconds from the lamp-on timing. For example, "the clearness ratio of 68%" indicates that the clearness occurs up to a vertical position of 68% in the longitudinal section of the sealed glass bulb.

The luminous flux value (lumen) after four seconds from the lamp-on timing denotes a luminous flux value after four seconds from lamp-on of the arc tube single body, which is an actual measurement value measured by an integrating sphere. The luminous flux value (%) after four seconds from the lamp-on timing denotes a ratio of the luminous flux value after four seconds from the lamp-on timing with respect to the arc tube single body when the electric discharge of the mercury-free arc tube is in a stable state (after five minutes from the lamp-on timing).

The luminous intensity value (cd) after four seconds from the lamp-on timing denotes a luminous intensity value in a predetermined light distribution point after four seconds of the lamp-on timing of the head lamp using the mercury-free arc tube as the light source. The luminous intensity value (%) after four seconds from the lamp-on timing denotes a ratio of the luminous intensity value (cd) after four seconds from the lamp-on timing with respect to the luminous intensity value after five minutes from the lamp-on timing, that is, a state where the electric discharge becomes stable.

A clearness proportional value (%) denotes a ratio of the luminous intensity value (%) after four seconds from the lamp-on timing with respect to the luminous flux value (%) after four seconds from the lamp-on timing. Thus, a large clearness proportional value indicates that the fog remaining in the side wall of the sealed glass bulb is small. That is, since a ratio at which the discharged light is diffused is small due to the fog, the luminous intensity rise of the head lamp becomes fast, and the delay (deviation) $\Delta t$ of the luminous intensity rise of the head lamp with respect to the luminous flux rises of the mercury-free arc tube is reduced.

Regarding an evaluation of the luminous intensity rise of the head lamp, it is determined whether the luminous intensity value (cd) after four seconds from the lamp-on timing satisfies the standard value (6520 cd) and 105% (6563 cd) of the standard value. A case where the luminous intensity value (cd) after four seconds from the lamp-on timing is equal to or greater than 105% (6563 cd) of the standard value is indicated by "0". A case where the luminous intensity value (cd) after four seconds from the lamp-on timing is equal to or greater than the standard value (6520 cd) but less than 105% (6563 cd) of the standard value is indicated by "Δ". A case where the luminous intensity value (cd) after four seconds from the lamp-on timing is less than the standard value (6520 cd) is indicated by "x".

Additionally, the lifetime indicates a lifetime of the mercury-free arc tube obtained by a durable test. A case where the lifetime is equal to or more than 2500 hours is indicated by "O". A case where the lifetime is equal to or greater than 2000 hours but less than 2500 hours is indicated by "A". A case where the lifetime is less than 2000 hours is indicated by "x".

FIG. 8A shows a relationship between the weight of the enclosed metal halide and the longitudinal-sectional clearness ratio of the sealed glass bulb after four seconds from the lamp-on timing, FIG. 8B shows a relationship between the Xe enclosure pressure and the longitudinal-sectional clearness ratio of the sealed glass bulb after four seconds from the lamp-on timing, FIG. 8C shows a relationship between the maximum input power and the longitudinal-sectional clearness ratio of the sealed glass bulb after four seconds from the lamp-on timing, FIG. 8D shows a relationship between the inner diameter (the inner diameter at a position in the middle of the electrodes) of the sealed glass bulb and the longitudinal-sectional clearness ratio of the sealed glass bulb after four seconds from the lamp-on timing, FIG. 8E shows a relationship between the density of the enclosed metal halide and the longitudinal-sectional clearness ratio of the sealed glass bulb after four seconds from the lamp-on timing, and FIG. 8F shows a relationship between the square value of the Xe enclosure pressure and the longitudinal-sectional clearness ratio of the sealed glass bulb after four seconds from the lamp-on timing.

Figure 9A:
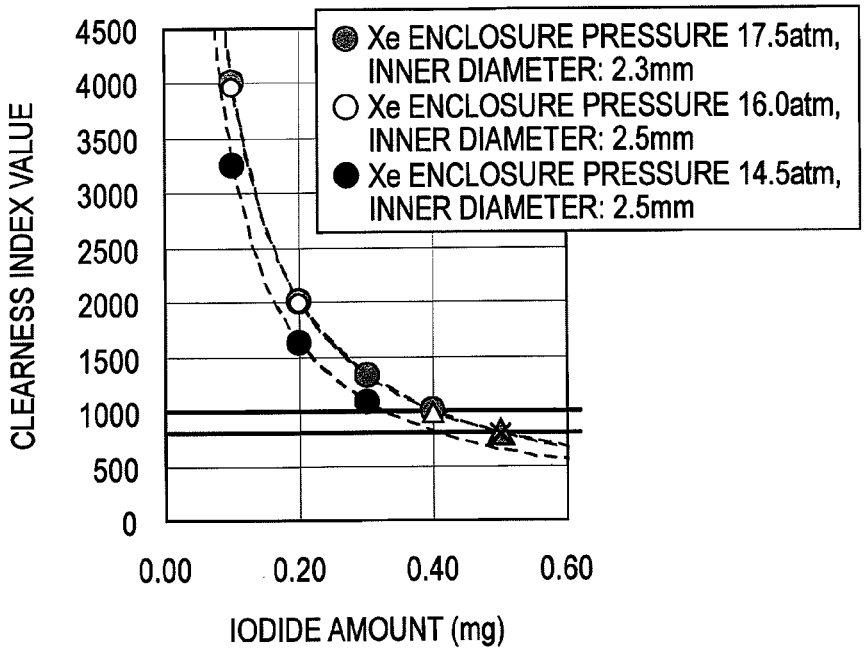
Figure 9B:
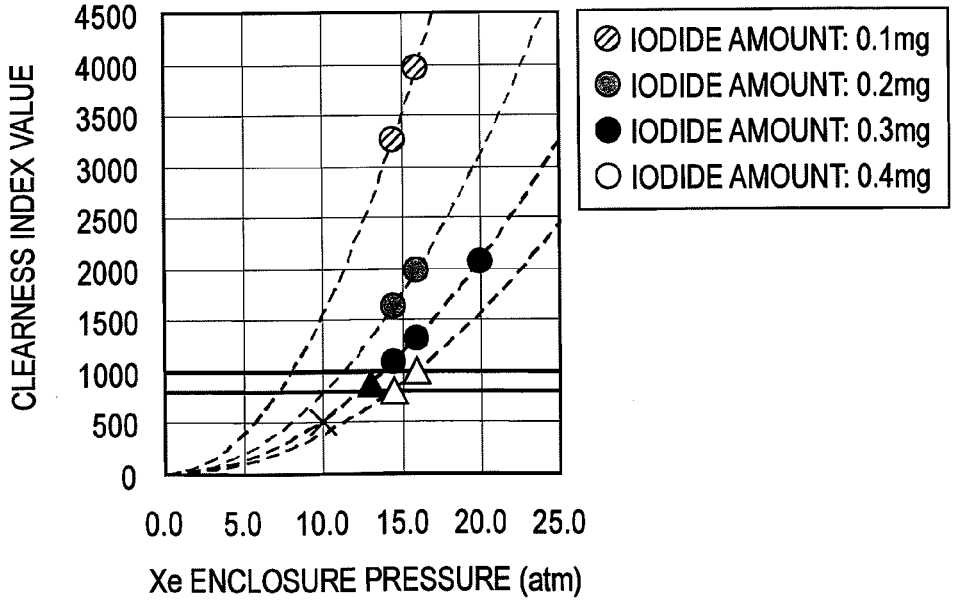
Figure 9C:
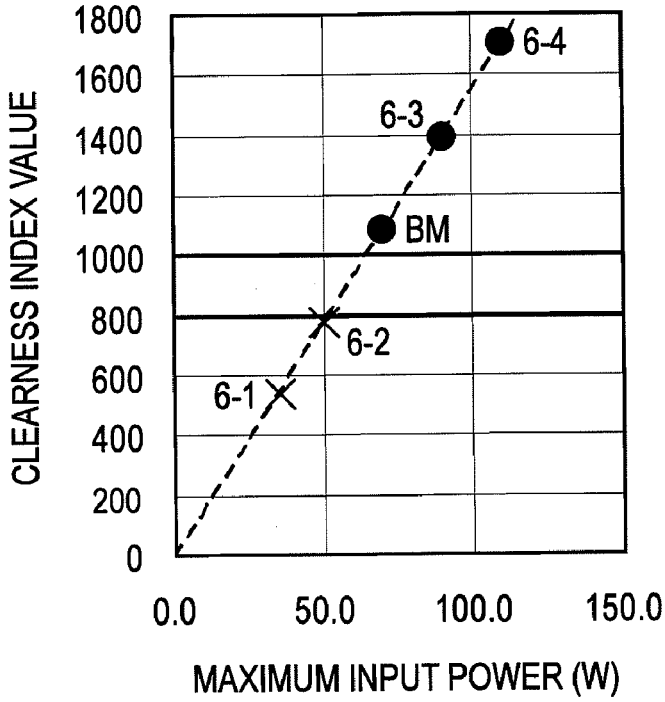
Figure 9D:
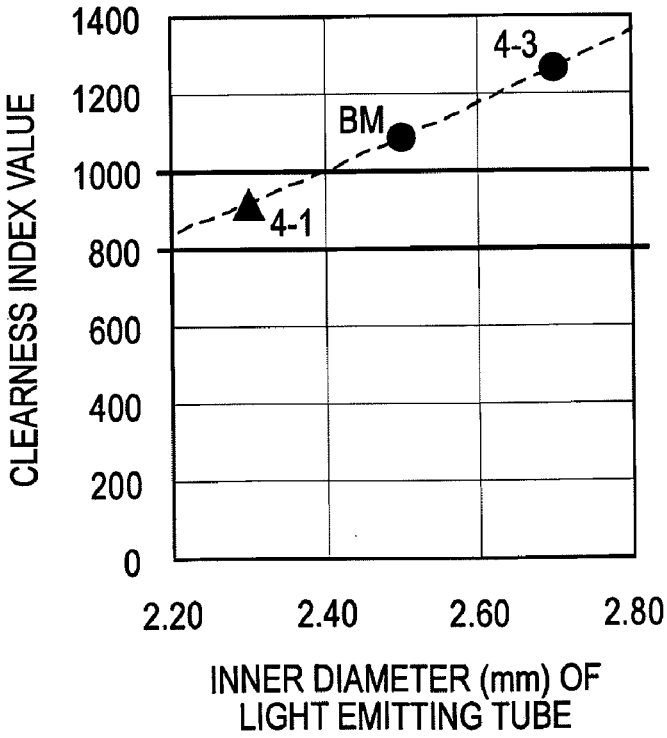
Figure 9E:
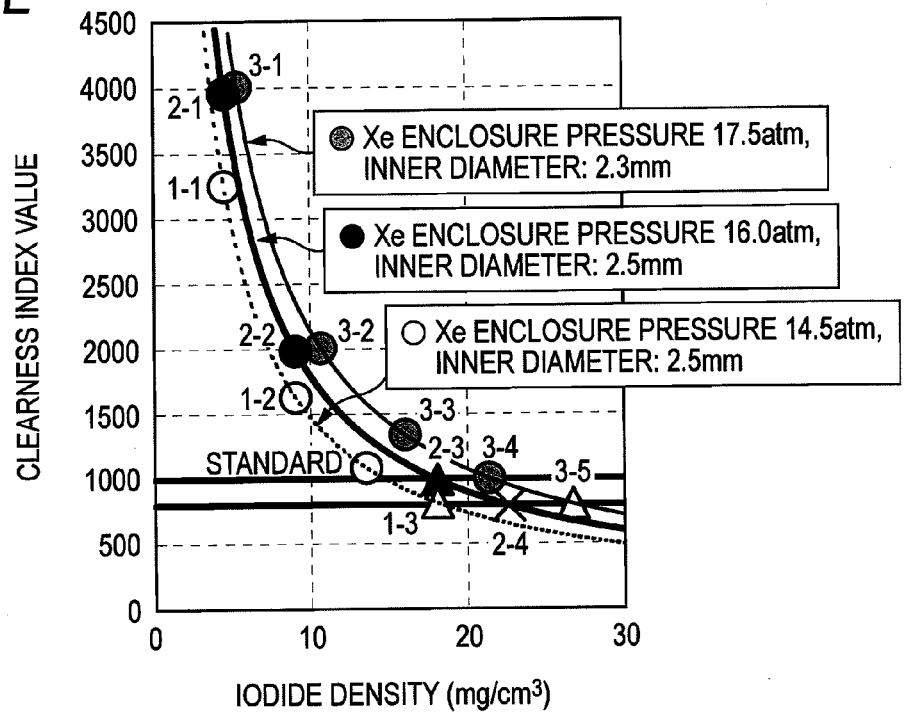
Figure 9F:
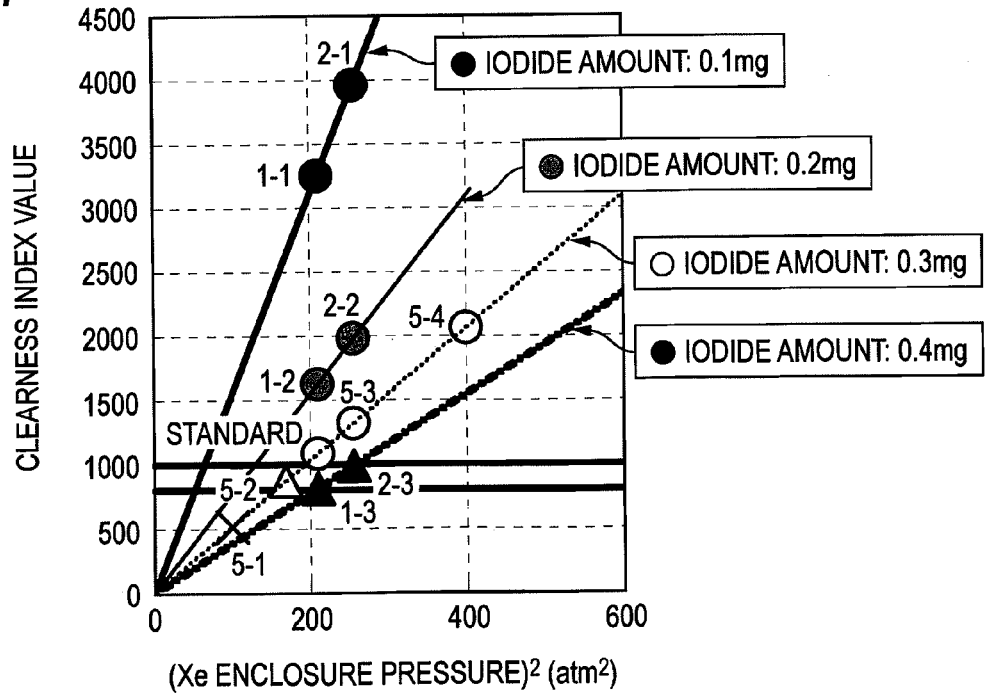

FIG. 9A shows a relationship between the clearness index value $P^2 \cdot W/\rho$ and the weight of the enclosed metal halide, FIG. 9B shows a relationship between the clearness index value $P^2 \cdot W/\rho$ and the pressure of the enclosed Xe gas, FIG. 9C shows a relationship between the clearness index value $P^2 \cdot W/\rho$ and the maximum input power, FIG. 9D shows a relationship between the clearness index value $P^2 \cdot W/\rho$ and the inner diameter (the inner diameter at a position in the middle of the electrodes) of the sealed glass bulb, FIG. 9E shows a relationship between the clearness index value $P^2 \cdot W/\rho$ and the density of the enclosed metal halide, and FIG. 9F shows a relationship between the clearness index value $P^2 \cdot W/\rho$ and the square value of the Xe enclosure pressure.

The numerical numbers shown in FIGS. 8A to 9F (e.g., "4-1", "4-2" or the like) correspond to the group numbers shown in FIGS. 4 to 7 (e.g., "Group 4-1", "Group 4-2" or the like). For example, the numerical numbers "6-1" to "6-4" shown in FIG. 8C correspond to the group numbers "Group 6-1" to "Group 6-4" shown in FIG. 5, respectively. Also, the numerical numbers "1-1" to "1-3" shown in FIG. 8E correspond to the group numbers "Group 1-1" to "Group 1-3" shown in FIG. 4.

From the experiment data shown in FIGS. 4 to 9F, it can be seen that the longitudinal-section clearness ration of the sealed glass bulb after four seconds is almost in inverse proportion to the density $\rho$ (mg/cm$^3$) of the enclosed metal halide and is almost in proportion to the square of the pressure P (atmosphere) of the Xe gas and the maximum input power W (watt), as shown in FIGS. 8A to 8C, 8E and 8F.

That is, as shown in FIG. 8E, the longitudinal-section clearness ration after four seconds is almost in inverse proportion to the density $\rho$ of the enclosed metal halide. In a case where the density $\rho$ of the enclosed metal halide is high (or the amount of the enclosed metal halide is large), the amount of the metal halide evaporated immediately after tuning on the arc tube is large. Thereby, the metal halide adhered to the tube wall is thickened.

Also, as shown in FIG. 8F, the longitudinal-section clearness ration after four seconds is in proportion to the square of the pressure P (atmosphere) of the Xe gas. In a case where the pressure P (atmosphere) of the Xe gas is high, a light emitting amount (heating amount) immediately after turning on the arc tube is large. Thereby the temperature in the sealed glass bulb is increased.

Also, as shown in FIG. 8C, the longitudinal-section clearness ration after four seconds is in proportion to the maximum input power W (watt). In a case where the maximum input power is large, the light emitting amount (heating amount) immediately after turning on the arc tube is large. Thereby the temperature in the sealed glass bulb is increased.

According to FIGS. 6 and 7, the clearness index value $P^2 \cdot W/\rho$ is likely to increase as the luminous flux (cd) of the vehicle headlamp after four seconds from lamp-on timing increases. That is, the fog of at least the upper half portion of the sealed glass bulb vanishes within four seconds from the time the lamp is turned on. Thus, the time difference (deviation) $\Delta t$ between the luminous flux rise of the bulb and the luminous intensity rise of the head lamp is reduced. Therefore, the luminous flux rise of the mercury-free arc tube and the luminous intensity rise of the vehicle headlamp using the mercury-free arc tube as a light source can be estimated based on the clearness index value "$P^2 \cdot W/\rho$", which is specified by the density (mg/cm$^3$) ρ of the enclosed metal halide in the sealed chamber of the mercury-free arc tube (the sealed glass bulb 12), the pressure P (atmospheres) of the enclosed Xe gas and the maximum input power W (watts), and the luminous flux values of the arc tube and the head lamp after four seconds from the lamp-on timing are increased as the clearness index value "$P^2 \cdot W/\rho$" is increased.

On the basis of the data, the clearness index value "$P^2 \cdot W/\rho$" tends to be large when the luminous intensity value (cd) after four seconds from the lamp-on timing is large. The luminous intensity value after four seconds from the lamp-on timing exceeds the standard (6520 cd) when the clearness index value "$P^2 \cdot W/\rho$" is equal to or greater than 800 (see FIG. 6). The luminous intensity value after four seconds from the lamp-on timing exceeds 105% (6563 cd) of the standard when the clearness index value "$P^2 \cdot W/\rho$" is equal to or greater than 1000 (see FIG. 7). Accordingly, as shown in FIGS. 6 and 7, the luminous-intensity-rise characteristic of the head lamp after four seconds of the lamp-on timing is excellent (the luminous intensity value after four seconds from the lamp-on timing is not less than the standard) when the clearness index value "$P^2 \cdot W/\rho$" is equal to or greater than 800, which corresponds to the Example. For details, with regard to five Examples 3-5 to 2-3 of "Example according to aspect 1" in FIG. 6, nine Examples 3-4 to 2-2 of "Example according to aspect 3" in FIG. 7, and five Examples 3-2 to 3-1 of "Example according to aspect 1" in FIG. 7, all of these Examples have the clearness index value $P^2 \cdot W/\rho$ whose value is 800 or more.

Particularly, when the clearness index value "$P^2 \cdot W/\rho$" is equal to or greater than 1000, the luminous-intensity-rise characteristic of the head lamp after four seconds from the lamp-on timing is better (i.e., the luminous intensity value after four seconds from the lamp-on timing is equal to or greater than 105% of the standard). With regard to nine Examples 3-4 to 2-2 of "Example according to aspect 3" in FIG. 7, and five Examples 3-2 to 3-1 of "Example according to aspect 1" in FIG. 7, all of these Examples have the clearness index value $P^2 \cdot W/\rho$ whose value is 1000 or more.

However, although it is described that the clearness index value "$P^2 \cdot W/\rho$" should be large, when the clearness index value exceeds about 2000, a burden to the arc tube components (e.g., the electrode or the glass) increases, and the lifetime of the mercury-free arc tube decreases to less than the Economic Commission for Europe (ECE) standard of 2500 hours. From the viewpoint of the durability (lifetime) of the mercury-free arc tube, the clearness index value "$P^2 \cdot W/\rho$" is advantageously not more than 2000. Accordingly, these nine Examples 3-4 to 2-2 of "Example according to aspect 3" are advantageous.

Meanwhile, in the Comparative Example 5-1, the pressure of the enclosed Xe gas is low (10 atmospheres), and an average free process of the discharged electrons becomes long. Accordingly, the light emission is small in the mercury-free arc tube, and the temperature rise in the mercury-free arc tube is slow. Additionally, in the Comparative Examples 6-1 and 6-2, the maximum input power is small (35 and 50 watt), and the number of discharged electrons is small. Accordingly, the light emission is small in the mercury-free arc tube, and the temperature rise in the mercury-free arc tube is slow. In each of the Comparative Examples, the luminous flux value itself after four seconds from the lamp-on timing does not increase, and the luminous intensity value after four seconds is small. In the Comparative Example 2-4, the density of the enclosed metal halide is large (22.64 mg/cm$^3$), and the fog caused by the metal halide adhered to the tube wall of the sealed chamber becomes extremely dense such that the light diffused by the fog increases. Accordingly, the luminous intensity value after four scones from the lamp-on timing is slightly smaller than the standard.

In the Example 6-4 (see FIG. 7), since the maximum input power is large (110 watt), and loss and damage of the electrode is high, the lifetime is short (2000 hours). Additionally, in the Examples 1-1, 2-1, and 3-1, since the densities of the enclosed metal halide are set to small values (4.53, 4.53, and 5.35 mg/cm$^3$ respectively), the discharge current is large and a consumption of the electrode is high. Accordingly, the lifetime is short (2000 hours, 2100 hours, and 2000 hours, respectively). In the Example 3-2, as compared with the Example 3-3 having a similar specification, the density of the enclosed metal halide is small (10.70 mg/cm$^3$ as compared with 16.5 mg/cm$^3$ of the Example 3-3). Accordingly, since the discharge current becomes large, the consumption of the electrode becomes slightly faster, and the lifetime is slightly shorter than 2500 hours.

In Example 5-4, since the pressure of the enclosed Xe gas is large (20 atmosphere), the temperature of the arc tube in the lamp-on timing becomes larger. Accordingly, since a chemical reaction between the metal halide and the arc tube components (e.g., the electrode or the glass) is promoted, the lifetime is comparatively small (2100 hours).

Further, in the above-described exemplary embodiment, the inner diameter D2 of the sealed glass bulb 12 is formed to have a range of about 2.3 to about 2.7 mm so that the arc bent portion is not noticed, but the inner diameter D2 of the sealed glass bulb 12 may be in the range of about 2 to about 3 mm.

Furthermore, in the above-described exemplary embodiment, the inner volume of the sealed glass bulb 12 is formed to have a range of about 18.7 to about 25.8 mm$^3$, but may be compact to be about 25.8 mm$^3$ or more or about 50 mm$^3$ (μl) or less.

According to Aspect 1 of the present invention, there is provided a mercury-free arc tube for a discharge lamp unit. The mercury-free arc tube includes a pair of electrodes; a sealed chamber in which a metal halide having at least Na and Sc is enclosed together with Xe gas serving as starting rare gas and which has an inner volume of 50 μl or less. In the tube, a clearness index value "$P^2 \cdot W/\rho$" is about 800 or more, wherein ρ denotes a density (mg/cm$^3$) of the enclosed metal halide, P denotes a pressure (atmospheres) of the enclosed Xe gas, and W denotes a maximum input power (watts).

As can be seen from FIGS. 8A to 8C, 8E and 8F, the longitudinal-section clearness ratio (i.e., the clearness degree of the sealed glass bulb when viewed from the side portion, which shows the degree that the upper edge of the obscure region decreases in the vertical direction) of the sealed glass bulb after four seconds is almost in inverse proportion to the density ρ (mg/cm$^3$) of the enclosed metal halide and is almost in proportion to the square of the pressure P (atmosphere) of the Xe gas and the maximum input power W (watt). Furthermore, as the longitudinal-section clearness ration of the sealed glass bulb after four seconds becomes larger, the luminous flux (cd) is likely to increase. That is, the fog of at least the upper half portion of the sealed glass bulb vanishes within four seconds from the time the lamp is turned on. Thus, the time difference (deviation) Δt between the luminous flux rise of the bulb and the luminous intensity rise of the head lamp is reduced.

Accordingly, the luminous flux rise of the mercury-free arc tube according to the exemplary embodiments and the luminous intensity rise of the head lamp using the mercury-free arc tube can be estimated based on the clearness index value "$P^2 \cdot W/\rho$", which is specified by the density (mg/cm$^3$) ρ of the enclosed metal halide in the sealed chamber (the sealed glass bulb 12), the pressure P (atmospheres) of the enclosed Xe gas and the maximum input power W (watts), and the luminous flux values of the arc tube and the head lamp after four seconds from the lamp-on timing are increased as the clearness index value "$P^2 \cdot W/\rho$" is increased.

As shown in FIGS. 6, 7, 9A to 9F, in a case where the clearness index value "$P^2 \cdot W/\rho$" is greater than or equal to 800, the luminous flux (cd) after four seconds from lamp-on timing becomes greater than or equal to 6250 cd as a standard value, so that the luminous flux rise of the vehicle headlamp can be improved and also lifetime (time or durability) of the vehicle headlamp can be improved.

Accordingly, when the mercury-free arc tube is turned on, as shown in FIG. 2, the luminous flux of the mercury-free arc tube gradually rises to thereby move to an electric discharge state capable of obtaining a substantially uniform luminous flux, and the luminous intensity of the head lamp rises at a timing slightly slower than a timing when the luminous flux of the mercury-free arc tube rises to thereby obtain a substantially uniform luminous intensity substantially corresponding to an electric discharge state having the uniform luminous flux of the mercury-free arc tube. A delay (deviation) Δt between the luminous flux rise of the mercury-free arc tube and the luminous intensity rise of the head lamp is shorter than that of the related art head lamp described in JP-A-2003-168391. Accordingly, a luminous-intensity-rise characteristic of the head lamp is improved.

According to Aspect 2 of the present invention, in the tube according to Aspect 1, the metal halide may include a buffer metal halide and a main light emitting metal halide, and in the sealed chamber, the buffer metal halide may be enclosed together with the main light emitting metal halide.

The main light emitting metal halide (NaI and $ScI_3$) is a substance mainly contributing to light emission. The buffer metal halide is at least one or more metal halide selected from halides Al, Bi, Cr, Cs, Fe, Ga, In, Mg, Ni, Nd, Sb, Sn, Tb, Tl, Ti, Li, and Zn. The buffer metal halide acts as a buffer substance for suppressing great reduction of a tube voltage instead of mercury and also acts as a light emitting substance substituted for mercury. Particularly, as shown in the exemplary embodiment, when the pressure of the enclosed starting rare gas (Xe gas) is large e.g., the pressure is about 13 to about 20 atmospheres larger than the 3 to 6 atmospheres of the related art mercury containing arc tube), a temperature of the inside of the sealed chamber in operation (at electrical discharge) becomes large to thereby increase a vapor pressure of the buffer metal halide. Also, a spectrum characteristic without Hg (a light intensity in a wavelength range near to 435 nm and/or 546 nm is low) is improved. Accordingly, it is possible to obtain a substantially same light emitting color (white) as that of the related art mercury containing arc tube and to obtain a substantially same light emitting amount as that of the related art mercury containing arc tube.

According to Aspect 3 of the present invention, in the tube according to Aspect 1, the clearness index value "$P^2 \cdot W/\rho$" is in a range of about 1000 to about 2000.

The clearness index value "$P^2 \cdot W/\rho$" specified by the density ρ (mg/cm$^3$) of the metal halide enclosed in the sealed chamber, the pressure P (atmospheres) of the enclosed Xe gas, and the maximum input power W (watts), as shown in FIGS. 6, 7, 9A to 9F, is equal to or greater than a lower limit value of about 1000 satisfying a condition that the upper edge of the obscure region after four seconds from the lamp-on timing is reliably positioned below the luminous point of the arc so that the luminous intensity value of the head lamp after four seconds from the lamp-on timing is not less than 6563 cd which is a value of 105% of a standard value. Accordingly, after four seconds, a state is attained where the luminous point of the arc can be clearly seen (visibly recognized) from the side portion of the sealed chamber. As a result, the luminance in the side portion (traverse direction) of the sealed chamber reliably increases, and the time difference (deviation) between the luminous flux rise of the bulb and the luminous intensity rise of the head lamp is further reduced. Thus, it is possible to reliably satisfy the luminous-intensity-rise standard (i.e., 6520 cd or more after four seconds from the lamp-on timing) of the head lamp and also to further reduce a time until the substantially uniform luminous intensity is obtained.

Additionally, in a vehicle head lamp, the luminous intensity of the head lamp changes in accordance with the output deviation of the ballast, and a loss occurs in accordance with an error of a dimension or a mounting operation of a light distribution forming means such as a reflector. However, in the mercury-free arc tube according to the illustrative aspects of the present invention, the luminous intensity value of the head lamp after four seconds from the lamp-on timing satisfies a value of 6563 cd which is a value that is 105% of the standard value. Accordingly, when the mercury-free arc tube is used as the light source of a head lamp, it is possible to obtain a light intensity that is equal to or greater than the standard.

Meanwhile, when the clearness index value "$P^2 \cdot W/\rho$" exceeds 2000, the consumption of the electrode increases and the load to the glass bulb increases to thereby reduce the lifetime of the arc tube. Accordingly, it is advantageous that the clearness index value is less than or equal to about 2000 from the viewpoint of the durability (lifetime) of the arc tube (see FIG. 7).

As described above, in the mercury-free arc tube according to the illustrative aspects of the present invention, the fog occurring in the tube wall of the sealed chamber immediately after the lamp-on timing becomes clear gradually from the upside, and the upper edge of the obscure region is positioned below the luminous point of the arc after four seconds from the lamp-on timing. Accordingly, the luminance in the side portion (traverse direction) of the sealed chamber increases, and the time difference (deviation) between the luminous flux rise of the arc tube and the luminous intensity rise of the head lamp is reduced. Thus, it is possible to provide a mercury-free arc tube for a discharge lamp unit capable of satisfying the luminous-intensity-rise standard (i.e., 6520 cd or more after four seconds from the lamp-on timing) of the head lamp and also capable of remarkably improving the luminous-intensity-rise characteristic of the head lamp.

Since the buffer metal halide acts as the light emitting substance or the buffer substance substituted for mercury, it is possible to provide the mercury-free arc tube for the discharge lamp unit which is the most suitable for the light source of the head lamp and is capable of obtaining the substantially same light emitting color (white) as that of the mercury containing arc tube and the substantially same light emitting amount as that of the mercury containing arc tube.

Since the time difference (deviation) between the luminous flux rise of the arc tube and the luminous intensity rise of the head lamp is further reduced, it is possible to provide a mercury-free arc tube for a discharge lamp unit which has the long lifetime and is capable of reliably satisfying the luminous-intensity-rise standard (i.e., 6520 cd or more after four seconds from the lamp-on timing) of the head lamp and also of further improving the luminous-intensity-rise characteristic of the head lamp.

While the present invention has been shown and described with reference to certain exemplary embodiments thereof, other implementations are within the scope of the claims. It will be understood by those skilled in the art that various changes in form and details may be made therein without departing from the spirit and scope of the invention as defined by the appended claims.

What is claimed is:

1. A mercury-free arc tube for a discharge lamp unit, the mercury-free arc tube comprising:

a plurality of electrodes;

a sealed chamber comprising a metal halide and a starting rare gas enclosed therein; and a means for supplying power to the plurality of electrodes at a time of luminous flux rise such that a clearness index value "$P^2 \cdot W/\rho$" is equal to or greater than about 800, where ρ denotes a density ($mg/cm^3$) of the enclosed metal halide, P denotes a pressure (atmospheres) of the enclosed starting rare gas, and W denotes a maximum input power (watts) input to the sealed chamber through the electrodes at the time of luminous flux rise.

2. The mercury-free arc tube according to claim 1, wherein the metal halide comprises a main light emitting metal halide and a buffer metal halide.

3. The mercury-free arc tube according to claim 2, wherein the main light emitting metal halide comprises NaI and $ScI_3$, the starting rare gas comprises Xe, and the buffer metal halide is at least one or more metal halides selected from Al, Bi, Cr, Cs, Fe, Ga, In, Mg, Ni, Nd, Sb, Sn, Tb, Tl, Ti, Li, and Zn.

4. The mercury-free arc tube according to claim 2, wherein the main light emitting metal halide comprises NaI and $ScI_3$, the starting rare gas comprises Xe, and the buffer metal halide comprises $ZnI_2$.

5. A mercury-free arc tube for a discharge lamp unit, the mercury-free arc tube comprising:

two electrodes;

a sealed chamber in which a metal halide comprising at least Na and Sc is enclosed together with Xe gas serving as starting rare gas; and a means for supplying power to the plurality of electrodes at a time of luminous flux rise such that a clearness index value $P^2 \cdot W/\rho$ is equal to or greater than about 800, where ρ denotes a density ($mg/cm^3$) of the enclosed metal halide, P denotes a pressure (atmospheres) of the enclosed Xe gas, and W denotes a maximum input power (watts) at the time of luminous flux rise.

6. The mercury-free arc tube according to claim 5, wherein the sealed chamber has an inner volume of about 50 μl or less.

7. The mercury-free arc tube according to claim 5, wherein the metal halide comprises:

a buffer metal halide and a main light emitting metal halide, the buffer metal halide and the main light emitting metal halide being enclosed together within the sealed chamber.

8. The mercury-free arc tube according to claim 5, wherein the clearness index value is in a range of about 1000 to about 2000.

9. The mercury-free arc tube according to claim 5, further comprising:

a shroud glass configured to surround the sealed chamber and configured to shield an ultraviolet light.

10. The mercury-free arc tube according to claim 7, wherein the main light emitting metal halide comprises NaI and $ScI_3$, and the buffer metal halide is at least one or more metal halides selected from Al, Bi, Cr, Cs, Fe, Ga, In, Mg, Ni, Nd, Sb, Sn, Tb, Tl, Ti, Li, and Zn.

11. The mercury-free arc tube according to claim 1, wherein a clearness index value "$P^2 \cdot W/\rho$" is equal to or greater than 800.

12. The mercury-free arc tube according to claim 5, wherein a clearness index value "$P^2 \cdot W/\rho$" is equal to or greater than 800.

13. The mercury-free arc tube according to claim 8, wherein a clearness index value "$P^2 \cdot W/\rho$" is in a range of 1000 to 2000.

14. A method, comprising:

providing a mercury-free arc tube for a discharge lamp unit, the mercury-free arc tube comprising a plurality of electrodes and a sealed chamber comprising a metal halide and a starting rare gas enclosed therein; and supplying power to the plurality of electrodes at a time of luminous flux rise, wherein a clearness index value "$P^2 \cdot W/\rho$" is equal to or greater than about 800, where ρ denotes a density (mg/cm3) of the enclosed metal halide, P denotes a pressure (atmospheres) of the enclosed starting rare gas, and W denotes a maximum input power (watts) input to the sealed chamber through the electrodes at the time of luminous flux rise.

15. The mercury-free arc tube according to claim 1, wherein each of the density of the enclosed metal halide, the pressure of the enclosed starting rare gas, and the maximum input power is set such that the clearness index value is equal to or greater than about 800.

16. The mercury-free arc tube according to claim 5, wherein each of the density of the enclosed metal halide, the pressure of the enclosed starting rare gas, and the maximum input power is set such that the clearness index value is equal to or greater than about 800.

* * * * *